US005607806A

United States Patent [19]

Kanbayashi et al.

[11] Patent Number: 5,607,806

[45] Date of Patent: Mar. 4, 1997

[54] TONER WITH ORGANICALLY TREATED ALUMINA FOR DEVELOPING ELECTROSTATIC IMAGE

[75] Inventors: Makoto Kanbayashi, Kawasaki; Wakashi Iida, Higashikurume, both of Japan

[73] Assignee: Canon Kabushiki Kaisha, Tokyo, Japan

[21] Appl. No.: 579,729

[22] Filed: Dec. 28, 1995

[30] Foreign Application Priority Data

Dec. 28, 1994 [JP] Japan ..... 6-337706
Dec. 12, 1995 [JP] Japan ..... 7-346462

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,797,339 | 1/1989 | Maruyama et al. | 430/110 |
| 4,891,294 | 1/1990 | Noguchi et al. | 430/110 |
| 5,212,037 | 5/1993 | Julien et al. | 430/110 |
| 5,334,472 | 8/1994 | Aoki et al. | 430/109 |
| 5,503,954 | 4/1996 | Maruta et al. | 430/111 |

FOREIGN PATENT DOCUMENTS 4202694 1/1993 Germany .

OTHER PUBLICATIONS

Patent Abstrs. of Japan, vol. 18, No. 405 (P–1778), Jul. 1994 for JP6–188690.

Patent Abstrs. of Japan, vol. 8, No. 196 (P–299) [1633], Sep. 1984 for for JP 59–084258.

*Primary Examiner*—Roland Martin

*Attorney, Agent, or Firm*—Fitzpatrick, Cella, Harper & Scinto

[57] ABSTRACT

A toner for developing electrostatic images includes: toner particles and organically treated alumina powder. The organically treated alumina powder has an X-ray diffraction characteristic showing a maximum X-ray intensity level $I_{a\text{-}max}$ and a minimum X-ray intensity level $I_{a\text{-}min}$ in a 2θ range of 20 to 70 degrees providing a ratio $I_{a\text{-}max}/I_{a\text{-}min}$ of below 6. The alumina powder is amorphous or has a low-crystallinity of γ-form, thereby showing a low agglomeratability to function as an effective flowability-improving agent for a toner. The structural water contained in the alumina powder contained favors hydrophobization treatment thereof and functions to suppress a charge-up phenomenon in a low humidity environment after the hydrophobization.

36 Claims, 5 Drawing Sheets

TONER WITH ORGANICALLY TREATED ALUMINA FOR DEVELOPING ELECTROSTATIC IMAGE

FIELD OF THE INVENTION AND RELATED ART

The present invention relates to a dry-system toner for developing electrostatic images for use, e.g., in electrophotography, electrostatic recording or electrostatic printing.

Hitherto, various methods for developing electrostatic images have been known as disclosed in U.S. Pat. Nos. 2,297,691, 3,666,363, 4,071,361, etc. In these methods, an electrostatic latent image is formed on a photosensitive member comprising a photoconductor by various means and then developed with a toner. The resultant toner image, after being optionally transferred onto a transfer-receiving material such as paper, is fixed by heating, pressure application, heating and pressure application or treatment with a solvent vapor to obtain a copy or a print. In a process including a transfer step, the residual toner remaining on the photosensitive member without being transferred is cleaned by various means.

Known developing methods include the powder cloud method disclosed in U.S. Pat. No. 2,221,776; the cascade developing method disclosed in U.S. Pat. No. 2,618,552; the magnetic brush method disclosed in U.S. Pat. No. 2,874,063; and a method using an electroconductive magnetic toner disclosed in U.S. Pat. No. 3,909,258.

Toner particles used in these developing methods are generally prepared through a process wherein a colorant is mixed and dispersed within a thermoplastic resin, and the mixture is finely pulverized to produce colorant-containing resin particles. The thermoplastic resin may generally be a polystyrene-based resin but may also comprise a polyester-based resin, an epoxy-based resin, an acrylate-based resin or a urethane-based resin. As a black colorant, carbon black is widely used. In the case of a magnetic toner, black magnetic powder of an iron oxide-based compound is used. In the case of a two component-type developer, a toner is blended with carrier particles, such as glass beads, iron powder or ferrite powder.

A toner image on a final image-forming sheet, such as paper, is fixed onto the sheet by application of heat, pressure, or heat and pressure.

In recent years, a development from a monocolor image formation to a full-color image formation is in rapid progress, e.g., in copying machines. Study and commercialization of two-color copiers or full-color copiers have made a great step forward. For example, some reports have been made on color reproducibility and gradation reproducibility in Journal of Electrophotographic Society of Japan (Denshi Shashin Gakkai-shi), Vol. 22, No. 1 (1983) and ditto, Vol. 25, No. 1, P52 (1986).

Image formation in full-color electrophotography is generally performed by reproducing all colors by using three color toners in three primary colors of yellow, magenta and cyan.

More specifically, in the process, a light image from an original is first passed through a color-separating high-transmission filter in a complementary color relationship with a toner color to form an electrostatic latent image on a photoconductor layer, followed by development and transfer to hold a toner image on a support. The steps are sequentially repeated in plural cycles while effecting registration on the support, thereby superposing toner images on the same support, which are subjected to a single step of fixation to form a final full-color image.

In a two component-type developer comprising a toner and a carrier, the toner is charged to a prescribed magnitude of a prescribed polarity through friction with the carrier and develops an electrostatic image while utilizing an electrostatic attractive force. Accordingly, in order to obtain a good quality of toner image, it is important to ensure a good triboelectric chargeability of toner which is principally determined by a relationship with the carrier.

Various studies have been made for accomplishing excellent triboelectric chargeability through investigation of carrier core materials and carrier coating materials, optimization of a coating amount, study on charge control agents and flowability improving agents added to toner and improvement in toner binder resin as a base material.

For example, a technique of adding a charging aid, such as chargeable fine particles, to a toner has been proposed by Japanese Laid-Open Patent Application (JP-A) 52-32256. JP-A 56-64352 has proposed the addition of resin fine powder of a polarity opposite to that of a toner. JP-A 61-160760 has proposed a technique of adding a fluorine-containing compound to a developer to obtain a stable triboelectric chargeability.

Various proposals have been made regarding addition of a charging aid as described above. For example, as a general technique, a charging aid is attached to toner particle surfaces based on electrostatic force or van der Waals force acting between toner particle and a charging aid by using a stirrer or a blender. However, it is not easy to uniformly disperse an additive on toner particle surfaces, and it is difficult to prevent additive particles from agglomerating with each other without being attached to toner particles to form the additive in an isolated state. This tendency becomes pronounced as the charging aid has a larger resistivity or comprise finer particles. In such a case, the toner performances are affected thereby. For example, the triboelectric charge becomes unstable to be liable to result in images with fluctuating image densities and accompanied with much fog.

Further, on continuation of copying, the content of the charging aid is changed so that it becomes difficult to retain an image quality at the initial stage.

As another addition technique, a charging aid may be added in advance together with the binder resin and the colorant at the time of toner particle production. Further, as the uniformization of a charge control agent is not easy, only a portion of the charging aid and the charge control agent present at the surface substantially contributes to the chargeability and portions thereof present inside the toner particles do not contribute to the chargeability, it is not easy to control the addition amount of the charging aid and the distribution thereof to the surface. Even toner particles obtained through this technique still have unstable triboelectric chargeability.

It has been proposed to stabilize the toner triboelectric chargeability by adding an external additive to toner particles. For example, the use of alumina which has been hydrophobized (i.e., subjected to a hydrophobicity-imparting treatment) has been proposed in JP-A 61-275862 and JP-A 61-275863. The alumina has been coated with amino-modified silicone oil and is accompanied with agglomerates in the alumina particles, so that it is difficult to provide the toner with a high flowability thereby.

Further, the use of hydrophobized alumina has been proposed in JP-A 62-8164, JP-A 62-129860, JP-A 62-129866, JP-A 62-209538, JP-A 4-345168 and JP-A 4-345169. However, these proposals have not referred to the surface activity and crystalline structure of alumina particles. Further, these alumina materials have been principally used for charge stabilization while being used in combination with silica to provide a high flowability to the toner, thus leaving a room for improvement regarding provision of high flowability by the alumina per se.

JP-A 2-251970 has disclosed alumina surface-treated with a coupling agent. The use of ordinary alumina subjected to a surface treatment alone is liable to leave a problem regarding charging stability in a high temperature/high humidity environment.

In order to ensure a flowability and a stable chargeability (particularly for avoiding an excessive charge in a low temperature/low humidity environment) by using hydrophobized alumina fine powder, JP-A 4-80254, JP-A 4-280255 and JP-A 4-345169 have proposed alumina fine powder having a hydrophobicity of 40% or higher. The hydrophobized alumina fine powder is actually effective in providing a stable chargeability but requires a further improvement in flowability-imparting effect compared with fine powder of silica, etc., having a high BET specific surface area.

Further, JP-A 3-191363 has proposed a toner containing hydrophobic γ-alumina abrasive substance. This is based on a study for uniformly and effectively exhibiting known abrasive effect of alumina in combination with an amorphous silicone photosensitive member and is different in nature from alumina fine powder for satisfying the two functions of flowability imparting and charge stabilization.

In recent years, there have been increasing demands for higher resolution and higher image quality for a copying machine. Further, a high-quality color image formation has been tried by using a toner of a smaller particle size. As the toner particle size is smaller, the toner is caused to have a larger surface area per unit weight and tends to have a larger chargeability, thus being liable to result in a lower image density and a deterioration in a continuous image formation. Because of a large toner charge, the toner particles exert a strong attractive force to each other and is liable to have a lower flowability, thus being liable to result in problems regarding the stability of toner replenishment and triboelectrification of the replenished toner.

In the case of a color toner containing no electroconductive substance, such as a magnetic material or carbon black, the toner contains no site allowing charge leakage and generally tends to have a larger charge. This tendency is more remarkable in the case of using a polyester-based binder having a high chargeability as a binder resin.

In addition to the triboelectric chargeability, a color toner is desired to exhibit the following properties:

(1) A toner assumes an almost complete molten state at the time of hot-pressure fixation so as not to allow discrimination of the toner particle shape, thereby providing a fixed image causing no random light reflection hindering color reproduction.

(2) A color toner provides a fixed toner layer having a clarity not hindering the hue of a lower color toner layer.

(3) Respective color toners have hues and spectral reflection characteristics balanced thereamong and sufficient saturations.

In these days, polyester-based resins have been frequently used as binder resins for color toners. However, a color toner comprising a polyester resin is liable to be affected by a change in temperature and/or humidity and cause a problem, such as an excessive charge in a low-humidity environment or an insufficient charge in a high-humidity environment. Accordingly, a color toner having a stabler chargeability in various environment has been desired.

SUMMARY OF THE INVENTION

A generic object of the present invention is to provide a toner for developing electrostatic images having solved the above-mentioned problems.

A more specific object of the present invention is to provide a toner for developing electrostatic images capable of forming clear images free from fog and showing excellent stability in continuous image forming performance.

A further object of the present invention is to provide a toner for developing electrostatic images showing excellent flowability, faithful developing performance and excellent transferability.

A further object of the present invention is to provide a toner for developing electrostatic images having a stable triboelectric chargeability which is less liable to be affected by changes in environmental conditions, such as temperature and/or humidity.

A further object of the present invention is to provide a toner for developing electrostatic images showing good cleanability and less liable to cause filming on the photosensitive member, or soiling.

A further object of the present invention is to provide a toner for developing electrostatic images excellent in fixability and capable of providing OHP images rich in transparency.

According to the present invention, there is provided a toner for developing electrostatic images, comprising: toner particles and organically treated alumina powder;

wherein the organically treated alumina powder has an X-ray diffraction characteristic showing a maximum X-ray intensity level $I_{a\text{-}max}$ and a minimum X-ray intensity level $I_{a\text{-}min}$ in a 2θ range of 20 to 70 degrees providing a ratio $I_{a\text{-}max}/I_{a\text{-}min}$ of below 6.

These and other objects, features and advantages of the present invention will become more apparent upon a consideration of the following description of the preferred embodiments of the present invention taken in conjunction with the accompanying drawings.

DETAILED DESCRIPTION OF THE INVENTION

As a result of our study for ensuring a stable chargeability and a high flowability, it has been found effective to use organically treated alumina powder having low-crystallinity as an external additive.

Figure 3:
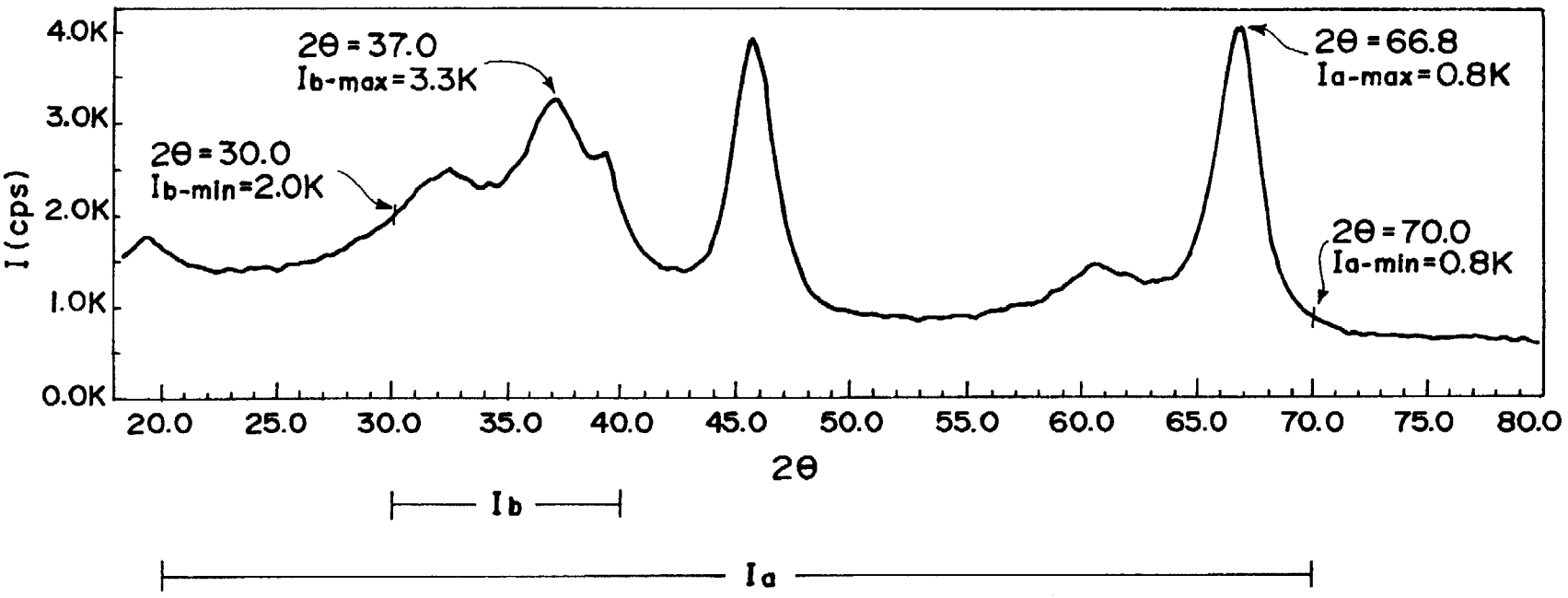
FIGS. 3–5 show X-ray diffraction patterns of alumina of low crystallinity, amorphous alumina and α-alumina, respectively.
Figure 4:
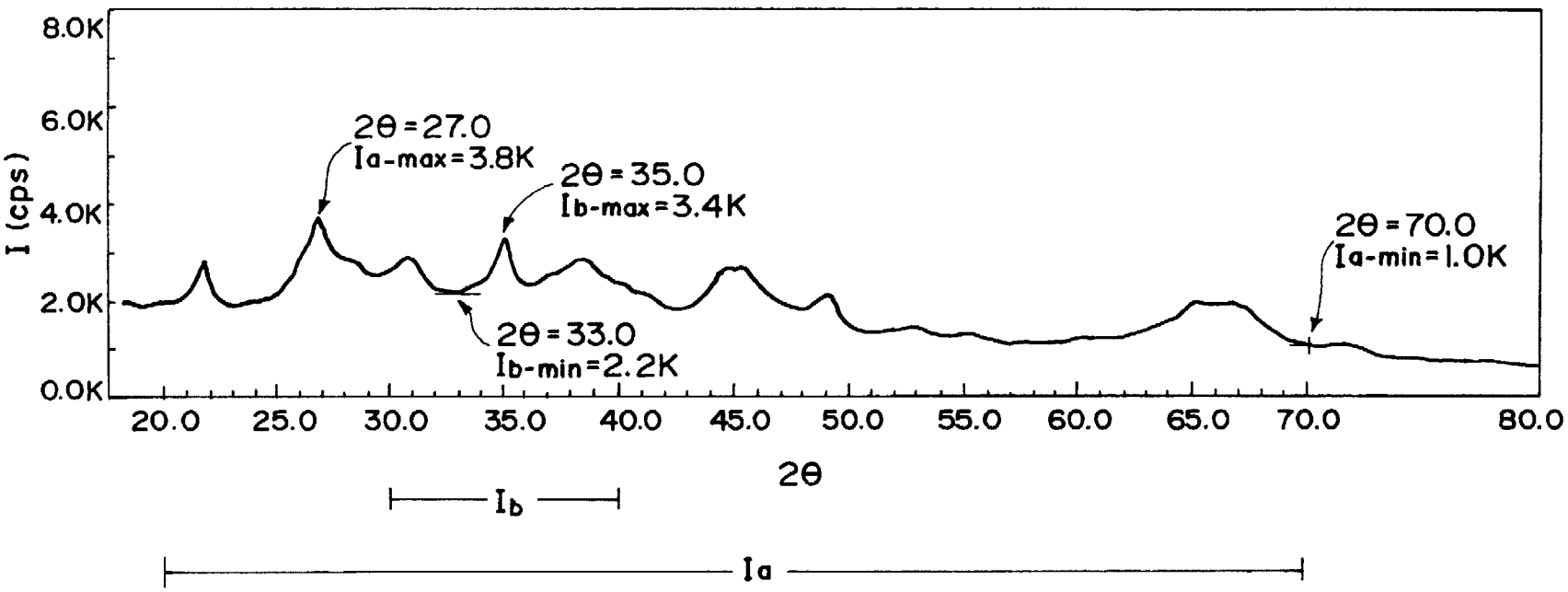

The organically treated alumina powder used in the present invention is characterized by a maximum (highest) X-ray intensity level $I_{a-max}$ and a minimum (lowest) X-ray intensity level $I_{a-min}$ in the range of $20 \leqq 2\theta \leqq 70$ (degrees) based on its X-ray diffraction data, so that it is amorphous or of low crystallinity and does not assume a clear crystal form (see FIGS. 3 and 4).

Figure 5:
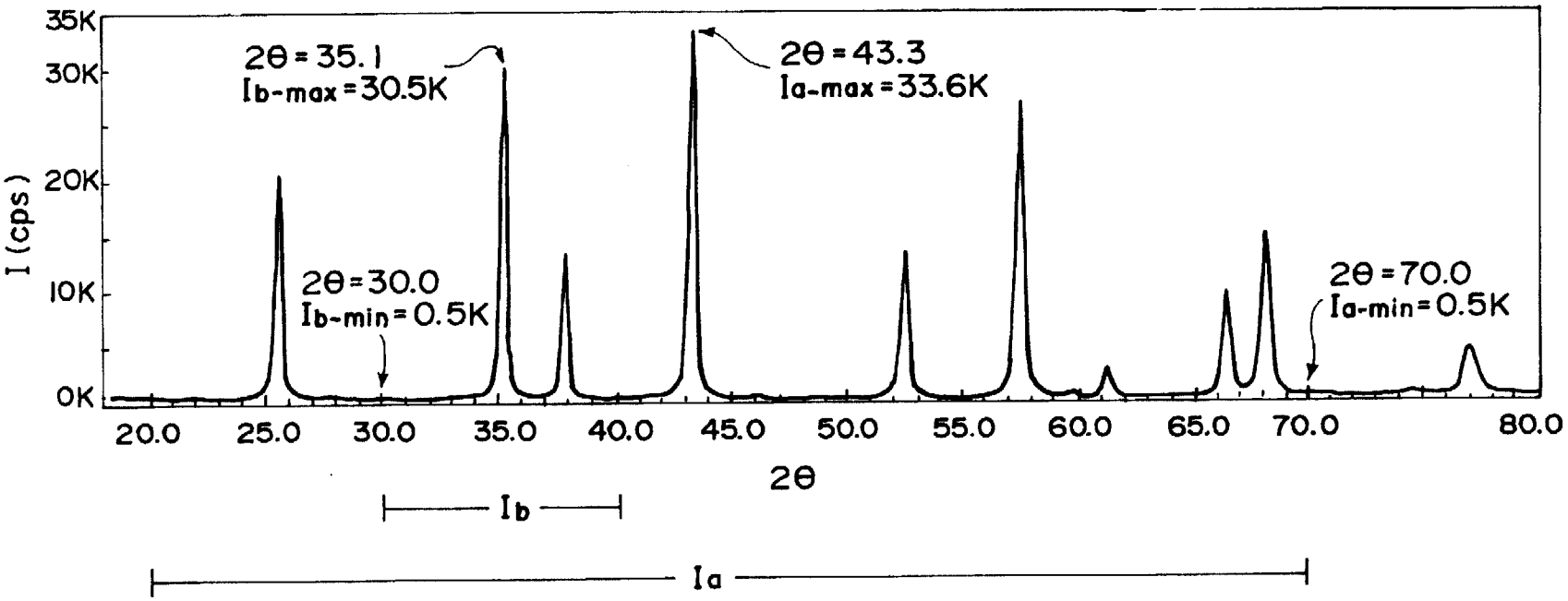

Generally, in a process for producing crystalline alumina powder, such as α-alumina powder, including a high-temperature sintering step or a step of hydrolysis or thermal decomposition, large alumina particles are necessarily formed due to coalescence at particle boundaries or particle growth during the crystal growth stage. α-Alumina powder shows a high crystallinity as represented by a high $I_{a-max}/I_{a-min}$ ratio of ca. 67 as shown in FIG. 5.

The high-temperature (flame) hydrolysis of anhydrous aluminum chloride can provide alumina particles with slightly suppressed crystal growth having a relatively small primary particle size, but the alumina powder shows an $I_{a-max}/I_{a-min}$ ratio exceeding 6 because of the high-temperature treatment. The alumina powder exhibits a large agglomeration force between alumina particles and a low surface activity, so that it is disadvantageous in an organic treatment (i.e., hydrophobization or hydrophobicity-imparting treatment).

In contrast thereto, the alumina powder used in the present invention does not show a clear crystal form, i.e., its crystal growth has been suppressed, the alumina particles are less liable to coalesce with each other and the degree of agglomeration therebetween is very weak. Accordingly, during mechanical dispersion thereof into primary particles in a liquid, the alumina particles can be easily disintegrated at a low dispersion energy and have a high surface activity allowing a uniform progress of organic treatment.

Accordingly, the organically treated alumina powder can impart a good flowability to toner particles and can thus promote the formation of high-quality toner images showing excellent reproducibility of thin lines and highlight portions of an original.

In addition, compared with ordinary alumina powder, the alumina powder used in the present invention has many active Al—OH groups at the powder surface and therefore has a high surface activity advantageous for reaction with an organic agent, thus allowing a uniform surface treatment. Further, in the step of mixing with toner particles, the organically treated alumina powder shows a good dispersibility and show a high attachment force to toner particle surfaces, so that the liberation thereof from the toner particle surfaces causing the soiling of carrier particle surfaces and the photosensitive drum is suppressed during continuous image formation, and the initial performances can be maintained for a long period even in a long period of continuous image formation.

The organically treated alumina powder used in the present invention may contain much structural water, which is much larger than that contain in the α-form alumina. Accordingly, the alumina powder may also function as powder having a type of leak point and can suppress excessive charge of toner particles. The effect is particularly exhibited in a low temperature—low humidity environment and also in the case of using a polyester resin as a binder resin. The effect is also remarkable when the toner particle size is reduced.

Further, the organically treated alumina powder used in the present invention may have a small particle size and can reduce the amount of secondary agglomerate to a very low level. Accordingly, when it is used as an external additive to a color toner for full-color image formation, the external additive thereof can be uniformly effected and clear OHP images having excellent transmittance for visible rays can be obtained. This has not been accomplished by conventional alumina fine powder.

In addition to the $I_{a-max}/I_{a-min}$ ratio of below 6 between the maximum X-ray intensity level $I_{a-max}$ and the minimum X-ray intensity level $I_{a-min}$ based on X-ray diffraction data, it is preferred to provide a ratio $I_{b-max}/I_{b-min}$ of below 2 between a maximum X-ray intensity level $I_{b-max}$ and a minimum X-ray intensity level $I_{b-min}$ in a 2θ range of $30 \leqq 2\theta \leqq 40$ (degrees).

Even an alumina powder satisfying Imax/Imin>6 can have a tendency of increased agglomeration force between alumina particles when it has been hydrolyzed or pylorized at a higher temperature to cause partial crystallization giving another peak in the range of $30 \leqq 2\theta \leqq 40$ (deg.). This is presumably due to a partial conversion into the α-form. Such alumina powder is liable to provide a lower flowability when blended with toner particles of a small particle size.

The range of $30 \leqq 2\theta \leqq 40$ (deg.) has been selected because alumina particles, when gradually treated at an elevated temperature, provide newly appearing peaks in the range, which peaks become sharper on progress of crystallization to provide a larger $I_{b-max}/I_{b-min}$ ratio, finally being shifted into a diffraction pattern of α-alumina having a clear crystal form.

Accordingly, in order to produce alumina powder having low agglomeratability, it is preferred to use alumina powder having an $I_{b-max}/I_{b-min}$ ratio of below 2 as a base material for providing the organically treated alumina powder.

The alumina powder as a base material for providing the organically treated alumina powder may preferably be one prepared by pyrolysis of aluminum ammonium carbonate hydroxide in a temperature range of 300°–1200° C.

It is preferred for example that aluminum ammonium carbonate hydroxide represented by the formula of:

$$NH_4AlO(OH)HCO_3 \quad (1),$$

or $$NH_4AlCO_3(OH)_2 \quad (2)$$

is calcined in a temperature range of 300°–1000° C., e.g., in an oxygen atmosphere to obtain alumina fine powder. It is preferred to use alumina fine powder obtained after a chemical reaction represented by the following formula:

$$2NH_4AlCO_3(OH)_2 \rightarrow Al_2O_3 + 2NH_3 + 3H_2O + 2CO_2.$$

The calcination temperature in the range of 300°–1200° C. is selected because it allows the production of an objective alumina powder having a high activity and a high BET specific surface area at a high yield. The aluminum ammonium carbonate hydroxide may preferably have a BET specific surface area as measured by nitrogen adsorption ($S_{BET}$) of at least 130 $m^2/g$, more preferably at least 150 $m^2/g$, most preferably at least 180 $m^2/g$.

In case where the calcination temperature is higher than 1200° C., the resultant alumina powder is caused to contain a remarkably increased proportion of α-alumina. Naturally, the powder causes a structural growth and is caused to have a larger primary particle size and a lower BET specific surface area. Moreover, the powder is liable to show a stronger coagulation between particles, thus requiring a much larger energy for dispersion before the organic treatment. By using such powder, it is difficult to obtain fine powder with little agglomerating particles even if the organic treatment step is optimized.

On the other hand, if the calcination temperature is below 300° C., the aluminum ammonium carbonate hydroxide cannot be completely or sufficiently pyrolized, so that the resultant alumina can contain residual gaseous component, such as $H_2O$, $NH_3$ or $CO_2$. In this case, it becomes difficult to obtain a sufficiently increased level of hydrophobicity even if a uniform hydrophobization treatment is tried. Further, even if an apparently high hydrophobicity is attained, it becomes difficult to provide a stable chargeability.

It is further preferred that the aluminum ammonium carbonate hydroxide is pyrolized in a temperature range of 300°–1100° C., further preferably 350°–1000° C., most preferably 400°–500° C.

The organically treated alumina powder having a ratio $I_{a\text{-}max}/I_{a\text{-}min}$ of below 6 may preferably be one which has been treated with a silane-based organic compound, particularly surface-treated with a silane coupling agent in a solution while causing hydrolysis.

The organically treated alumina powder may preferably have a methanol hydrophobicity (i.e., a hydrophobicity as measured by methanol titration) of 30–90 in order to provide a good environmental stability.

In contrast with silica fine particles which per se show a strong negative chargeability, alumina powder has an almost neutral chargeability, so that an objective level of chargeability can be attained by controlling the degree of hydrophobization. It has been already proposed to add hydrophobic alumina powder to a toner. However, alumina powder inherently has a surface activity which is much lower than silica, so that the hydrophobization has not been effected necessarily sufficiently. By using a larger amount of treating agent or a high-viscosity treating agent, it is actually possible to attain a high hydrophobicity. In such a case, however, the particles are liable to coalesce with each other to result in a lower BET specific surface area and a lower ability of imparting a flowability to a toner, so that the stabilization of chargeability and the flowability improvement have not been necessarily satisfactorily performed.

The hydrophobization agent used in the present invention may be appropriately selected depending on the object of surface-reforming (e.g., chargeability control, or further stabilization of chargeability in a high humidity environment) and the reactivity of the treating agent. Examples thereof may include silane-type organic compounds inclusive of alkylalkoxysilanes, siloxanes, silanes, and silicone oils. The treating agent may preferably be free from thermal decomposition at treatment temperatures.

A preferred class of the treating agent may include alkylalkoxysilanes having a volatility and both a hydrophobic group and a reactive group, such as coupling agents, as represented by the following formula:

$$R_m\ Si\ Y_n,$$

wherein R denotes an alkoxy group; m denotes an integer of 1–3; Y denotes a hydrocarbon group, such as an alkyl group, vinyl group, glycidoxy group, and methacryl group; and n denotes an integer of 1–3.

Specific examples thereof may include: vinyltrimethoxysilane, vinyltriethoxysilane, γ-methacryloxypropyltrimethoxy-silane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

It is further preferred to use an alkylalkoxysilane represented by the formula:

$$C_aH_{2a+1}-Si(OC_bH_{2b+1})_3,$$

wherein a denotes an integer of 4–12, b denotes an integer of 1–3.

If the number a in the above formula is below 4, the treatment may become easier but it is difficult to obtain a sufficient hydrophobicity. If a is larger than 12, the treated alumina powder may have a sufficient hydrophobicity but is liable to cause coalescence of the particles, thus having a lower flowability-imparting effect. If the number b is larger than 3, the reactivity is lowered and it becomes difficult to provide a sufficient hydrophobicity.

Accordingly, in the present invention, it is further preferred that a is 4–12, more preferably 4–8, and b is preferably 1–3, more preferably 1–2.

The hydrophobizing agent may preferably be used in an amount of 1–50 wt. parts, more preferably 3–45 wt. parts, per 100 wt. parts of the alumina powder so as to provide a hydrophobicity of 30–90%, more preferably 40–80%.

If the hydrophobicity is below 30%, the resultant toner is liable to cause a lowering in chargeability after standing for a long period in a high humidity environment, thus requiring a charging enhancement mechanism based on a hardware consideration, so that the apparatus is liable to be complicated. On the other hand, if the hydrophobicity exceeds 90%, the chargeability control of the alumina powder per se becomes difficult, so that the toner is liable to cause a charge-up (i.e., have an excessive charge) in a low humidity environment.

The treated alumina powder may preferably have an average particle size of 0.002–0.1 μm, more preferably 0.005–0.05 μm in view of its flowability-improving performance.

If the average particle size is larger than 0.1 μm, the flowability is liable to be unstable, thus resulting toner scattering and fog, so that it becomes difficult to form high-quality images. If the average particle size is smaller than 0.002 μm, the treated alumina powder is liable to be embedded at the surface of toner particles (colorant-containing resin particles), thus being liable to cause an early deterioration of toner performance and a lower toner performance in a continuous image formation. This liability is more pronounced in the case of a sharp-melting color toner. Further, below 0.002 μm, alumina particles have a high activity and are liable to agglomerate with each other, so that it becomes difficult to provide an objective high flowability. The average particle size of the treated alumina powder referred to herein is based on values measured by observation through a transmission-type electron microscope with respect to particles having a size of at least 0.001 μm.

In the present invention, the treatment of alumina powder may suitably be performed in a process wherein the alumina powder is mechanically dispersed into its primary particles in a liquid medium and treated with a coupling agent while causing the hydrolysis of the latter. However, this is just an example and another process may also be used.

In the toner of the present invention, the treated alumina powder may preferably be contained in a proportion of 0.5–5 wt. parts, more preferably 0.6–3 wt. parts, further preferably 0.7–2.5 wt. parts, per 100 wt. parts of the toner particles.

Below 0.5 wt. part, the resultant toner is caused to have only a low flowability. On the other hand, above 5 wt. parts, the alumina powder is liable to be released from the toner particles and the released alumina powder is liable to soil the carrier surface and lower the charge-imparting ability of the carrier per se. Further, the released treated alumina powder is liable to fly onto the photosensitive member surface at the time of development, thus being liable to cause cleaning failure. Further, in the case of a color toner, a larger amount of treated alumina powder is liable to result in a shade in an OHP projected image.

The organically treated alumina powder used in the present invention may preferably have a BET specific surface area ($S_{BET}$) of at least 130 $m^3/g$, more preferably at least 150 $m^2/g$.

A BET specific surface area of below 130 $m^2/g$ means that the alumina powder comprises largely grown particles, even if the crystal growth has been suppressed, or partially contains α-alumina, so that it is difficult to obtain a high flowability. The organically treated alumina powder having a BET specific surface area of below 130 $m^2/g$, in spite of a very high BET specific surface area before the treatment, means that alumina particles in the form of agglomerate without sufficient dispersion in a liquid medium are reacted with the treating agent or that the treating agent per se causes condensation and is attached in its oily state to the alumina particles or agglomerates thereof.

Next, the toner particle size distribution will be described.

As a result of our study on image density, highlight reproducibility and thin line-reproducibility of developers, it has been found that toner particles having a weight-average particle size of 3–7 μm allows a faithful development of a latent image on a photosensitive member, and particularly toner particles having particle sizes of below 4 μm remarkably contribute to provide an improvement in highlight reproducibility.

In case where the toner particles have a weight-average particle size in excess of 7 μm, there may be attained advantages such that a high image density can be obtained easily and the toner flowability is excellent, but toner particles cannot readily be attached faithfully to fine or thin electrostatic images on the photosensitive drum, so that the highlight reproducibility is impaired and it becomes difficult to attain a good resolution. An excessive toner coverage is liable to occur, thus resulting in an increase in toner consumption.

On the other hand, if the toner has a weight-average particle size below 3 μm, the toner is liable to have an excessively high charge to result in a noticeable decrease in image density particularly in a low temperature—low humidity environment. This is unsuitable for forming images having a high areal percentage, such as graphic images.

Further, a toner having a weight-average particle size below 3 μm cannot be easily triboelectrically charged with a carrier and is caused to contain an increased amount of insufficiently charged toner particles, thus resulting in a noticeable scattering to non-image parts (i.e., fog). The use of a smaller particle size carrier may be considered in order to cope with the problem, but a toner having a weight-average particle size below 3 μm is also liable to cause self-agglomeration, so that it is difficult to realize uniform mixing with a carrier in a short time and the toner is liable to be insufficiently charged in a continuous image formation accompanied with continual toner replenishment.

Accordingly, in the present invention, it is preferred to use a toner having a weight-average particle size of 3–7 μm.

The toner according to the present invention may preferably contain toner particles having particle sizes of at most 4 μm in a proportion of 10–70% by number, more preferably 15–60% by number, of the total toner particles. Less than 10% by number of the toner particles having particle sizes of at most 4 μm means that fine toner particles as an essential component for giving a high-quality image is little, and they are liable to be decreased on continuation of image formation (copying or printing out) to result in an inferior toner particle size distribution and gradually deteriorate the image quality.

If the toner particles having particle sizes of at most 4 μm exceed 70% by number, they are liable to agglomerate with each other to function as larger toner particle blocks and thus provide rough images with a lower resolution or hollow images with a large density difference between the edge portion and inside portion.

Toner particles having particle sizes of 8 μm or larger may preferably be contained in a proportion of 2–20 vol. %, more preferably 3.0–18.0 vol. %. If the toner particles having particle sizes of 8 μm or larger are more than 20 vol. %, the toner is liable to provide an inferior image quality and cause an excessive toner coverage, thus resulting in an increased toner consumption. On the other hand, if the toner particles having sizes of 8 μm or larger are less than 2 vol. %, the toner is liable to have a lower flowability, thus providing a low image quality.

In order to fully exhibit the effects of the present invention by improving the chargeability and flowability of the toner, toner particles having sizes of at most 5.04 μm may preferably be contained in 40–90% by number, more preferably 40–80% by number, and the amount of toner particles having sizes of 10.08 μm or larger should be suppressed to at most 6 vol. %, more preferably at most 4 vol. %.

In order to successfully use a toner of a small particle size, it is important to improve the flowability and stabilize the chargeability.

Accordingly, in order to allow the toner having the above-mentioned particle size distribution to fully exhibit its performances and realize a high resolution and a high gradation, it is important to use the above-mentioned surface-treated alumina powder having a large flowability-imparting effect.

A smaller particle size toner is liable to cause toner scattering, but the alumina powder used in the present invention also has a high chargeability improving performance which is in good compatibility with a flowability-improving effect, to suppress the toner scattering.

It is further preferred that the toner shows an agglomeratability of 2–25%, more preferably 2–20%, further preferably 2–15%.

If the agglomeratability exceeds 25%, the conveyability of the toner from a toner hopper to a developing device is lowered, and difficulties, such as poor mixing of the toner and the carrier and insufficient charge of the toner, are liable to be encountered. Accordingly, even if the toner is reduced in size and is provided with a proper coloring performance, it is difficult to obtain high-quality images.

It has been a common practice to add silica fine powder having a large BET specific surface area in order to lower the agglomeratability of a toner, but the addition of silica fine powder is liable to lower the environmental adaptability of the toner, thus resulting in a lower toner charge in a high humidity environment or a higher toner charge in a low humidity environment. Further, as silica fine powder per se shows a large negative chargeability, the use thereof as an external additive enhances the electrostatic agglomeratability among toner particles, so that it becomes difficult to obtain an objective toner having a high flowability.

The binder resin used for providing toner particles may be known binder resin materials for toners for electrophotography.

Examples thereof may include: styrene-copolymers, such as styrene-butadiene copolymer, styrene-acrylate copolymer, and styrene-methacrylate copolymer; polyethylene, ethylene copolymers, such as ethylene-vinyl acetate copolymer and ethylene-vinyl alcohol copolymer; phenolic resin, epoxy resin, allyl phthalate resin, polyamide resin, polyeter resin, and maleic acid-based resin.

The present invention is particularly effective when a polyester resin having a high negative chargeability is used among these resins. Polyester resin is rich in fixability and suited for a color toner. On the other hand, polyester resin has a strong negative chargeability and is liable to be excessively charged, but this difficulty can be alleviated by using the treated alumina powder to provide an excellent toner.

It is particularly preferred to use a polyester resin obtained by co-polycondensation of a diol component comprising a bisphenol derivative represented by the formula:

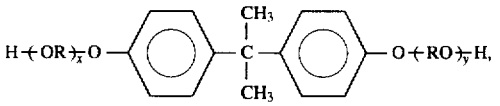

(A)

wherein R denotes an ethylene or propylene group, x and y are independently a positive integer of at least 1 with the proviso that the average of x+y is in the range of 2–10, or a substitution derivative thereof, with a carboxylic acid component comprising a carboxylic acid having two or more carboxylic groups, an anhydride thereof or a lower alkyl ester thereof (e.g., fumaric acid, maleic acid, maleic anhydride, phthalic acid, terephthalic acid, trimellitic acid, and pyromellitic acid), because of a sharp-melting characteristic of the polyester resin.

As a non-magnetic colorant used in the present invention, it is possible to use a known non-magnetic dye or pigment, examples of which may include: Phthalocyanine Blue, Indanthrene Blue, Peacock Blue, Permanent Red, Lake Red, Rhodamine Lake, Hansa Yellow, Permanent Yellow, and Benzidine Yellow. The content thereof may sensitively affect the transparency of an OHP film and may be at most 12 wt. parts, preferably 0.5–9 wt. parts, per 100 wt. parts of the binder resin.

In order to provide a negatively chargeable toner, it is preferred to add a charge control agent. As a negative charge control agent, it is possible to use, e.g., an organic metal complex or an organic metal salt, such as metal complexes of alkyl-substituted salicylic acids (e.g., chromium complex, aluminum complex or zinc complex of ditertiary-butylsalicylic acid). In order to provide a negatively chargeable color toner, it is preferred to use a colorless or pale-colored negative charge control agent.

Examples of a positive charge control agent used for providing a positively chargeable toner may include: nigrosin or triphenylmethane compounds, rhodamine dyes, and polyvinylpyridine. In order to provide a positively chargeable toner, it is preferred to use a colorless or pale-colored positive charge control agent not adversely affecting the hue of the toner.

The toner according to the present invention can further contain another additive within an extent of not impairing the properties of the toner. Examples of such another additive may include: charging aids, such as organic resin particles or metal oxide; lubricants, such as polytetrafluoroethylene, zinc stearate or polyvinylidene fluoride; and fixing aids, such as low-molecular weight polyethylene, low-molecular weight polypropylene or ester wax.

The toner particles used in the present invention may be produced by sufficiently mixing a binder resin, a pigment or dye as a colorant, and optional additives such as a charge control agent and others, by means of a blender such as a Henschel mixer or a ball mill; then melting and kneading the mixture by hot kneading means, such as hot rollers, kneaders and extruders to disperse or dissolve the pigment or dye in the resins; cooling and pulverizing the mixture; and subjecting the pulverized product to strict classification to toner particles which are colorant-containing resin particles.

In case where the toner according to the present invention is used for constituting a two-component type developer, the toner is used together with a carrier which may for example comprise a surface-oxidized or non-oxidized particles of metals, such as iron, nickel, copper, zinc, cobalt, manganese, chromium or rare earth metals, their magnetic alloys, magnetic oxides and magnetic ferrites.

In the case of a coated carrier comprising a carrier core coated with a coating material, carrier core particles may be coated with a resin by applying the resin in the form of a solution or suspension onto the core particles, by powder blending or by another known method.

The coating material firmly applied onto the carrier core may vary depending on the toner material but may comprise one or more of materials, such as polytetrafluoroethylene, monochlorotrifluoroethylene polymer, polyvinylidene fluoride, silicone resin, polyester resin, styrene resin, acrylic resin, polyamide, polyvinyl butyral, and aminoacrylate resin.

The coating material may be used in an appropriate amount but may preferably be used in 0.1–30 wt. %, more preferably 0.5–20 wt. %, of the resultant carrier.

The carrier may preferably have an average particle size of 10–100 μm, more preferably 20–70 μm.

A particularly preferred type of carrier may comprise particles of a magnetic ferrite surface-coated with a combination of a silicone resin or fluorine-containing resin and a styrene-based resin, such as a combination of polyvinylidene fluoride and styrene-methyl methacrylate resin, a combination of polytetrafluoroethylene and styrene-methyl methacrylate resin, a combination of fluorine-containing copolymer and styrene copolymer, and a combination of silicone resin and styrene-based copolymer in a weight ratio of 90:10–20:80, more preferably 70:30–30:70, at a coating rate of 0.01–5 wt. %, more preferably 0.1–1 wt. %. The coated carrier particles may preferably contain at least 70 wt. % of particles having a size of 250 mesh-pass and 400 mesh-on and have the above-mentioned average particle size. The fluorine-containing copolymer may for example comprise vinylidene fluoride/tetrafluoroethylene copolymer (copolymerization weight ratio of 10/90–90/10). The styrene copolymer may include: styrene/2-ethylhexyl acrylate (20/80–80/20) and styrene/2-ethylhexylacrylate/methyl methacrylate (20–60/5–30/10–50).

The above-mentioned coated magnetic ferrite carrier has a sharp particle size distribution and shows an excellent triboelectrification effect for the toner according to the present invention to provide improved electrophotographic performances.

The toner according to the invention and a carrier may be blended in such a ratio as to provide a toner concentration of 2–15 wt. %, preferably 3–13 wt. %, more preferably 4–10 wt. %, whereby good results are obtained ordinarily. At a toner concentration of below 2 wt. %, the image density is liable to be lowered. Above 15 wt. %, the image fog and scattering of toner in the apparatus are increased, and the life of the developer is liable to be shortened.

Figure 1:
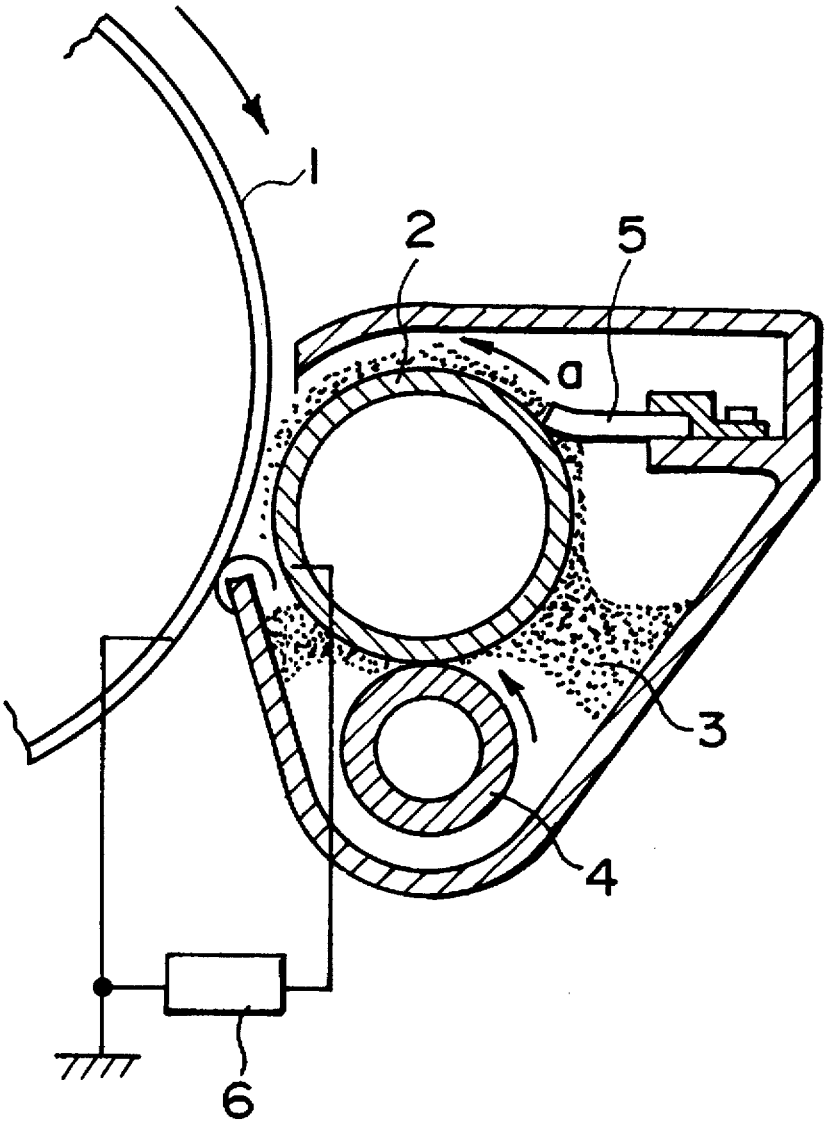
FIG. 1 is a schematic illustration of an example of developing apparatus in which a non-magnetic mono-component toner as an embodiment of the toner for developing electrostatic images may be used.

A non-magnetic mono-component toner according to the present invention may be used for development in a developing apparatus, e.g., as shown in FIG. 1. FIG. 1 illustrates a developing apparatus for developing an electrostatic image formed on an electrostatic image-bearing member. Such an electrostatic image may be formed on the electrostatic image-bearing member 1 by an electrophotographic process means or electrostatic recording means (not shown). A developer-carrying member 2 is composed of a non-magnetic sleeve comprising a material, such as aluminum or stainless steel. A non-magnetic mono-component color toner is contained in a hopper 3 and supplied from a supply roller 4 onto the developer-carrying member 2. The supply roller 4 also has a function of peeling or scraping the toner on the developer-carrying member 2 after the development. The toner supplied onto the developer-carrying member 2 is uniformly coated in a thin layer by a developer coating blade 5. The coating blade 5 may suitably be abutted against the developer-carrying member so as to exert a linear pressure of 3–250 g/cm, preferably 10–120 g/cm, in a direction along a sleeve generatrix. If the abutting pressure is below 3 g/cm, it is difficult to effect a uniform toner application, thus resulting in a broad toner charge distribution leading to fog or toner scattering. If the abutting pressure exceeds 250 g/cm, the toner is supplied with a large pressure to cause agglomeration of the particles or be pulverized. By adjusting the abutting pressure within the range of 3–250 g/cm, the agglomerated small particle size toner can be well disintegrated so that the triboelectric charge of the toner can be increased in a short time. The developer coating blade 5 may preferably comprise a material having a position in a triboelectrification series suitable for charging the toner to a desired polarity.

More specifically, the blade 5 may suitably comprise, e.g., silicone rubber, urethane rubber, or styrene-butadiene rubber. An electroconductive rubber may suitably be used for avoiding the excessive triboelectric charge of toner. It is also possible to surface-coat the blade 5. Particularly, for use in combination with a negatively chargeable toner, it is suitable to coat the blade with a positively chargeable resin, such as polyamide resin.

In the system using the blade 5 for forming a thin toner layer on the developer-carrying member 2, it is preferred to set the toner layer thickness on the developer carrying member 2 to be smaller than a gap between the developer-carrying member 2 and the electrostatic image-bearing member 1 disposed opposite to each other and apply an alternating electric field across the gap. Thus, a developing bias electric field of an alternating electric field alone or superposed with a DC electric field between the developer-carrying member 2 and the electrostatic image-bearing member 1 by a bias power supply 6 shown in FIG. 1, so as to facilitate the movement of the toner from the developer-carrying member 2 to the electrostatic image-bearing member 1, thereby providing good quality of images.

An image forming apparatus suitable for practicing full-color image forming method by using toners of the present invention will be described with reference to FIG. 2.

Figure 2:
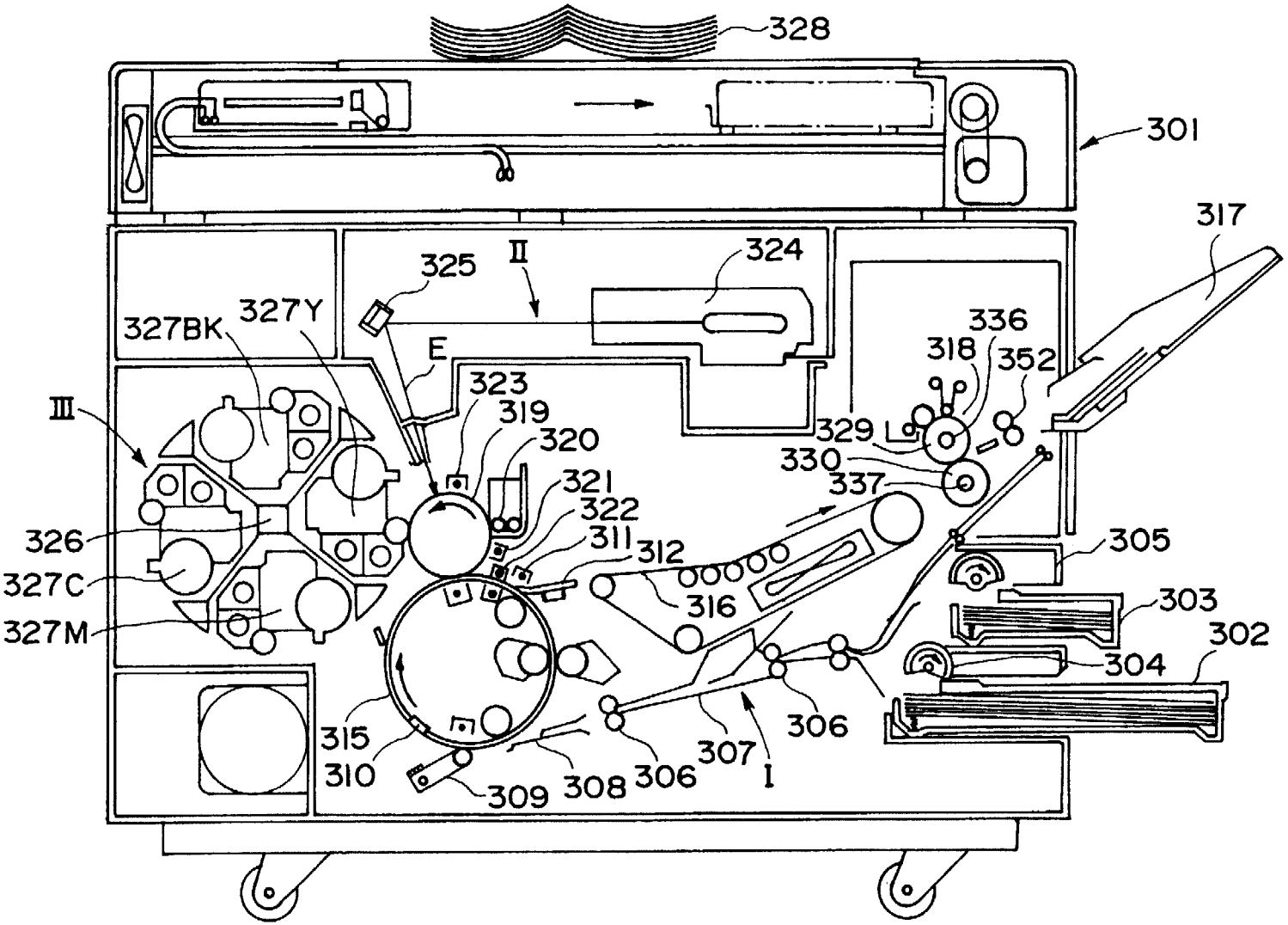
FIG. 2 is a schematic illustration of a full-color copying machine in embodiments of the toner for developing electrostatic images according to the present invention may be used.

The color electrophotographic apparatus shown in FIG. 2 is roughly divided into a transfer material (recording sheet)-conveying section I including a transfer drum 315 and extending from the right side (the right side of FIG. 2) to almost the central part of an apparatus main assembly 301, a latent image-forming section II disposed close to the transfer drum 315, and a developing means (i.e., a rotary developing apparatus) III.

The transfer material-conveying section I is constituted as follows. In the right wall of the apparatus main assembly, an opening is formed through which are detachably disposed transfer material supply trays 302 and 303 so as to protrude a part thereof out of the assembly. Paper (transfer material)-supply rollers 304 and 305 are disposed almost right above the trays 302 and 303. In association with the paper-supply rollers 304 and 305 and the transfer drum 315 disposed leftward thereof so as to be rotatable in an arrow A direction, paper-supply rollers 306, a paper-supply guide 307 and a paper-supply guide 308 are disposed. Adjacent to the outer periphery of the transfer drum 315, an abutting roller 309, a gripper 310, a transfer material separation charger 311 and a separation claw 312 are disposed in this order from the upperstream to the downstream alone the rotation direction.

Inside the transfer drum 315, a transfer charger 313 and a transfer material separation charger 314 are disposed. A portion of the transfer drum 315 about which a transfer material is wound about is provided with a transfer sheet (not shown) attached thereto, and a transfer material is closely applied thereto electrostatically. On the right side above the transfer drum 315, a conveyer belt means 316 is disposed next to the separation claw 312, and at the end (right side) in transfer direction of the conveyer belt means 316, a fixing device 318 is disposed. Further downstream of the fixing device is disposed a discharge tray 317 which is disposed partly extending out of and detachably from the main assembly.

The latent image-forming section II is constituted as follows. A photosensitive drum (e.g., an OPC photosensitive drum) as a latent image-bearing member rotatable in an arrow direction shown in the figure is disposed with its peripheral surface in contact with the peripheral surface of the transfer drum 315. Generally above and in proximity with the photosensitive drum 319, there are sequentially disposed a discharging charger 320, a cleaning means 321 and a primary charger 323 from the upstream to the downstream in the rotation direction of the photosensitive drum 319. Further, an imagewise exposure means including, e.g., a laser 324 and a reflection means like a mirror 325, is disposed so as to form an electrostatic latent image on the outer peripheral surface of the photosensitive drum 319.

The rotary developing apparatus III is constituted as follows. At a position opposing the photosensitive drum 319, a rotatable housing (hereinafter called a "rotary member") 326 is disposed. In the rotary member 326, four-types of developing devices are disposed at equally distant four radial directions so as to visualize (i.e., develop) an electrostatic latent image formed on the outer peripheral surface of the photosensitive drum 319. The four-types of developing devices include a yellow developing device 327Y, a magenta developing device 327M, a cyan developing apparatus 327C and a black developing apparatus 327BK.

The entire operation sequence of the above-mentioned image forming apparatus will now be described based on a full color mode. As the photosensitive drum 319 is rotated in the arrow direction, the drum 319 is charged by the primary charger 323. In the apparatus shown in FIG. 2, the moving peripheral speeds (hereinafter called "process speed") of the respective members, particularly the photosensitive drum 319, may be at least 100 mm/sec, (e.g., 130–250 mm/sec). After the charging of the photosensitive drum 319 by the primary charger 323, the photosensitive drum 329 is exposed imagewise with laser light modulated with a yellow image signal from an original 328 to form a corresponding latent image on the photosensitive drum 319, which is then developed by the yellow developing device 327Y set in position by the rotation of the rotary member 326, to form a yellow toner image.

A transfer material (e.g., plain paper) sent via the paper supply guide 307, the paper supply roller 306 and the paper supply guide 308 is taken at a prescribed timing by the gripper 310 and is wound about the transfer drum 315 by means of the abutting roller 309 and an electrode disposed opposite the abutting roller 309. The transfer drum 315 is rotated in the arrow A direction in synchronism with the photosensitive drum 319 whereby the yellow toner image formed by the yellow-developing device is transferred onto the transfer material at a position where the peripheral surfaces of the photosensitive drum 319 and the transfer drum 315 abut each other under the action of the transfer charger 313. The transfer drum 315 is further rotated to be prepared for transfer of a next color (magenta in the case of FIG. 2).

On the other hand, the photosensitive drum 319 is charge-removed by the discharging charger 320, cleaned by a cleaning blade or cleaning means 321, again charged by the primary charger 323 and then exposed imagewise based on a subsequent magenta image signal, to form a corresponding electrostatic latent image. While the electrostatic latent image is formed on the photosensitive drum 319 by image-wise exposure based on the magenta signal, the rotary member 326 is rotated to set the magenta developing device 327M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 322 and 314, released from holding by the gripper 310, separated from the transfer drum 315 by the separation claw 312 and sent via the conveyer belt 316 to the fixing device 318, where the four-color toner images are fixed under heat and pressure. Thus, a series of full color print or image formation sequence is completed to provide a prescribed full color image on one surface of the transfer material.

In this instance, the fixing operation by the fixing device 318 is performed at a speed (e.g., 90 mm/sec) slower than the peripheral speed of the photosensitive drum 319 (e.g., 160 mm/sec). This is in order to provide an amount of heat to the toner sufficient for melt-mixing an unfixed image comprising two to four toner layers, so that an increased amount of heat is given by a slower fixing speed than the developing speed.

Various measurement methods giving parameters characterizing the invention will be described below.

(1) Toner particle size distribution

A Coulter counter (Model "TA-II" or "Multisizer II", available from Coulter Electronics, Inc.) is used as an instrument. A ca. 1%-NaCl aqueous solution as an electrolyte solution is prepared by using a reagent-grade sodium chloride. A commercially available electrolyte solution (e.g., "ISOTON-II", available from Coulter Scientific Japan K.K.) may also be used. Into 100 to 150 ml of the electrolyte solution, 0.1–5 ml of a surfactant (preferably an alkylbenzenesulfonic acid salt) is added as a dispersant, and 2–20 mg of a sample is added thereto. The resultant dispersion of a sample in the electrolyte liquid is subjected to a dispersion treatment for ca. 1–3 min., and then subjected to a particle size measurement by using a 100 μm-aperture to measure volumes and numbers of toner particles for respective channels, from which a weight average particle size ($D_4$) of the toner sample is calculated based on a volume-basis distribution of toner particles by using a mid value as a representative for each channel.

The following 13 channels are used: 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm, 12.70–16.00 μm; 16.00–20.20 μm; 20.20–25.40 μm; 25.40–32.00 μm; and 32.00–40.30 μm.

(2) Agglomeratability

An agglomeratability is used as a measure for evaluating the flowability of a powdery sample (e.g., a toner including an external additive), and a larger agglomeratability means a poorer flowability.

As a measurement instrument, a powder tester (available from Hosokawa Micron K.K.) including a digital vibration meter ("DIGIVIBRO MODEL 1332") is used.

For measurement, sieves of 200 mesh, 100 mesh and 60 mesh are superposed and set in this order on a vibration table so that the 60 mesh-sieve is placed on top.

A Sample accurately weighed at 5 g is placed on the 60 mesh-sieve and is subjected to vibration for ca. 15 sec. while setting an input voltage of 21.7 volts to the vibration table, a displacement value of 0.130 at the digital vibration meter and adjusting a vibration width of the vibration table within a range of 60–90 μm (a rheostat scale of ca. 2.5). The weights of the sample remaining on the respective sieves are measured and an agglomeratability is calculated from the following equation:

$$\text{Agglomeratability (\%)} = (\text{sample weight on 60 mesh-sieve}/5\text{ g}) \times 100 + (\text{sample weight on 100 mesh-sieve}/5\text{ g}) \times 100 \times 3/5 + (\text{sample weight on 200 mesh-sieve}/5\text{ g}) \times 100 \times 1/5.$$

A powder sample is left to stand for ca. 12 hours in an environment of 23° C. and 60% RH and then measured in the same environment.

(3) Average particle size of alumina powder

As for a primary particle size, an alumina powder sample is observed through a transmission electron microscope to measure the particle sizes of 100 particles with sizes of at least 0.001 μm in the view field, from which a number-average particle size is obtained. As for a dispersed particle size on toner particles, a sample is observed through a scanning electron microscope and 100 alumina particles in the view field are examined with an X-ray microanalyzer (XMA) to measure the particle sizes, from which a number-average is obtained.

(4) Hydrophobicity

A methanol titration test is performed for experimentally measuring the hydrophobicity of alumina powder having a hydrophobized surface.

More specifically, the methanol titration test may be performed by adding 0.2 g of a powder sample into 50 ml of water in a vessel and titrating the dispersion by adding methanol through a buret until all the powder is wetted therewith while continually stirring the content in the vessel with a magnetic stirrer. The terminal point of the titration may be recognized by all the powder is suspended within the liquid. The hydrophpbicity is measured as a content (percentage) of methanol in the methanol-water mixture at the terminal point of the titration.

(5) BET specific surface area

The BET specific surface area of a powder sample (e.g., alumina powder) is measured according to the BET multi-point method by using a full-automatic gas adsorption apparatus ("AUTOSORB 1", available from Yuasa Ionics K.K.) and nitrogen as the adsorption gas. The sample is pretreated by 10 hours of evacuation at 50° C.

(6) Crystal structure analysis

Crystal structure analysis of alumina powder is performed based on an X-ray diffraction spectrum by using Kα rays among Cu-characteristic X-rays. The measurement may be performed by using a high-power full-automatic X-ray diffraction apparatus ("MXP[18]", available from MAC SCIENCE K.K.).

An alumina having a clear crystalline structure, i.e., α-form alumina, provides sharp peaks in a 2θ range of 20–70 degrees. An example of X-ray diffraction pattern of α-alumina (product of Comparative Synthesis Example 2 appearing hereinafter) is shown in FIG. 5. On the other hand, FIG. 4 shows an X-ray diffraction pattern example of amorphous alumina (product of Synthesis Example 1), and FIG. 3 shows an X-ray diffraction pattern example of γ-alumina of low crystallinity (product of Synthesis Example 2). Incidentally, it has been confirmed that the X-ray diffraction patterns are not substantially changed by the organic treatment.

Hereinbelow, the present invention will be described with reference to Examples and Comparative Examples.

Synthesis Example 1 of organically treated alumina powder

Into a 2M-ammonium bicarbonate solution, a 0.2M-ammonium alum solution was added dropwise while maintaining the liquid temperature at 35° C. to cause a reaction under stirring. $NH_4AlCO_3(OH)_2$ crystal thus formed and aged was filtered, dried and heated at ca. 650° C. for ca. 2 hours to form alumina powder, which provided an X-ray diffraction pattern showing no clear peaks and giving a ratio $I_{a\text{-}max}/I_{a\text{-}min}$ of 3.16.

Then, the alumina powder was uniformly dispersed in toluene, and isobutyltrimethoxysilane (silane coupling agent) was added dropwise thereto in a proportion of solid content of 30 wt. parts per 100 wt. parts of the alumina powder so as to cause hydrolysis without causing the coalescence of the particles. Then, the solid product was filtered, dried and baked at 180° C. for 2 hours, followed by disintegration to provide objective surface treated alumina powder 1. Treated alumina powder 1 thus obtained showed a primary average particle size (Dav.) of 0.005 μm, a BET specific surface area ($S_{BET}$) of 270 $m^2/g$ and a methanol hydrophobicity ($H_{MeOH}$) of 63%.

Comparative Synthesis Example 1 of organically treated alumina powder $AlCl_3$ was decomposed in a gaseous phase and sintered at a relatively high temperature to form γ-type hydrophillic alumina powder showing a ratio $I_{a\text{-}max}/I_{a\text{-}min}$ of 6.12. The hydrophillic alumina powder was surface-treated for hydrophobization in the same manner as in Synthesis Example 1 to obtain Comparative treated alumina powder 1.

Comparative Synthesis Example 2 of organically treated alumina powder $NH_4AlCO_3(OH)_2$ crystal produced in Synthesis Example 1 was calcined at ca. 1260° C. for ca. 60 min. to obtain α-alumina powder, which provided an X-ray diffraction pattern showing sharp and clear peaks and was confirmed to be of the α-form.

The α-alumina powder was surface-treated for hydrophobization in a similar manner as in Synthesis Example 1 except for reducing the treating rate to 10 wt. %, to obtain Comparative treated alumina powder 2.

Synthesis Example 2 of organically treated alumina powder $NH_4AlCO_3(OH)_2$ crystal produced in Synthesis Example 1 was calcined at ca. 800° C. to prepare alumina powder, which provided an X-ray diffraction pattern showing broad peaks at 2θ=45 deg. and 67 deg., and was in the γ-crystal form.

Then, the alumina powder was uniformly dispersed in toluene, and normal-butyltrimethoxysilane was added dropwise thereto in a proportion of solid content of 25 wt. parts per 100 wt. parts for hydrophobization, otherwise in a similar manner as in Synthesis Example 1, to obtain Treated alumina powder 2.

Synthesis Example 3 of organically treated alumina powder

Treated alumina powder 3 was prepared in the same manner as in Synthesis Example 2 except that the amount of the normal-butyltrimethoxysilane was increased to 40 wt. parts in solid content.

Synthesis Example 4 of organically treated alumina powder $NH_4AlCO_3(OH)_2$ crystal produced similarly as in Synthesis Example 1 was calcined at ca. 1050° C. and sufficiently disintegrated to form alumina powder.

The alumina powder was treated for hydrophobization similarly as in Synthesis Example 1 except for reducing the treating amount to 20 wt. parts to prepare Treated alumina powder 4.

Comparative Synthesis Example 3 of organically treated alumina powder

Comparative Treated alumina powder 3 was prepared in the same manner as in Synthesis Example 4 except for using a commercially available γ-alumina ($S_{BET}$146 $m^2/g$) formed by pyrolysis of aluminum alkoxide.

Comparative Synthesis Example 4 of organically treated titania powder

Hydrophobic titanium oxide of rutile-form having a primary particle size of ca. 30 nm obtained by sintering at a high temperature was treated for hydrophobization in the same manner as in Synthesis Example 3 to prepare Comparative treated titania powder 4.

The physical properties of the above-prepared organically treated powders are summarized in Table 1 appearing hereinafter.

EXAMPLE 1

| | |
|---|---|
| Polyester resin (produced by polycondensation of propoxidized bispenol and fumaric acid) | 100 wt. parts |
| Phthalocyanine pigment (colorant) | 4 wt. parts |
| Cr-complex salt of di-tert-butylsalicylic acid (negative charge control agent) | 4 wt. parts |

The above materials were sufficiently pre-blended by a Henschel mixer and melt-kneaded through a twin-screw extruder, followed by cooling, coarse crushing into particles of ca. 1–2 mm by a hammer mill and fine pulverization by a pulverizer of the air jet-type. The fine pulverizate was classified to obtain colorant-containing resin particles (negatively chargeable non-magnetic toner particles) having a weight-average particle size ($D_4$) of ca. 5.7 μm.

100 wt. parts of the negatively chargeable toner particles and 1.2 wt. parts of Treated alumina powder 1 of Synthesis Example 1 were blended by a Henschel mixer to obtain a cyan toner having a weight-average particle size of 5.7 μm. The treated alumina powder on the toner particles were observed through a SEM (scanning election microscope), whereby it was confirmed that the powder al most in its primary particle form was uniformly attached onto the toner particle surfaces. The toner showed an agglomeratability of 12%.

A coated ferrite carrier was prepared by coating a Cu—Zn—Fe—based magnetic ferrite carrier having an average particle size of 50 μm with 0.5 wt. % of a styrene/methyl methacrylate/2-ethylhexyl acrylate (50/20/30 by weight) copolymer, and 95 wt. parts of the coated ferrite carrier and 5 wt. parts of the above-prepared cyan toner were blended to prepare a two-component type developer.

The two-component type developer was charged in a commercially available plain paper color copier ("Color Laser Copier 550", available from Canon K.K.) and used for image formation at a set developing contrast of 300 volts in an environment of 23° C./65% RH. The thus-formed images were subjected to a reflection density measurement by using a Macbeth densitometer ("RD918", available from Macbeth Co.) using an SPI filter (similarly as in the image density measurement described hereinafter). As a result, the toner images showed a high image density of 1.62 and were found to be clear and free from fog. The copying was further continued on 10,000 sheets and, during that time, the cyan toner retained a prescribed triboelectric charge and provided images which were accompanied with only a small density fluctuation of 0.08 and were clear and fog-free similarly as in the initial stage. Image formation was also performed in a low temperature/low humidity environment of 20° C./10% RH at a set developing contrast of 300 volts, whereby the resultant images showed a high image density of 1.54, indicating a good chargeability control in a low humidity environment.

A cyan toner image transferred onto an OHP film and fixed thereon was subjected to overhead projection, thereby providing a clear cyan projected image on a screen.

Image formation was also performed in a high temperature/high humidity environment of 30° C./80% RH at a set developing contrast of 300 volts, whereby good images showing a very stable image density of 1.68 were obtained.

Further, when the developer was subjected to standing for one month in environments of 23° C./60% RH, 20° C./10% RH and 30° C./80% RH, the developer after the standing in each environment showed no abnormality.

The particle size distribution and agglomeratability of the toner are shown in Table 2, and the image forming performances of the toner are shown in Table 3, respectively appearing hereinafter.

Comparative Example 1

A toner and a two-component type developer were prepared in the same manner as in Example 1 except for using untreated alumina powder ($I_{a\text{-}max}/I_{a\text{-}min}$=3.16, $I_{b\text{-}max}/I_{b\text{-}min}$=1.7, $S_{BET}$=360 $m^2/g$, Dav. =5 nm, $H_{MeOH}$=0%). The developer was tested in the same manner as in Example 1 in a high temperature/high humidity environment (30° C./80% RH), whereby the resultant images showed a higher image density but were generally accompanied with much fog compared with those obtained in Example 1.

Comparative Example 2

A toner and a two-component type developer were prepared and evaluated in the same manner as in Example 1 except for using Comparative treated alumina powder 1.

As a result of continuous image formation in the high temperature/high humidity environment, the toner showed a stable chargeability in the initial stage but, on continuation of the image formation, the chargeability was lowered to result in severe toner scattering in the apparatus, so that the image formation was interrupted.

Comparative Example 3

A toner and a two-component type developer were prepared and evaluated in the same manner as in Example 1 except for using Comparative treated alumina powder 2. The toner showed a high agglomeratability of 56%, and the agglomeratability was not substantially improved even when the external addition amount of Comparative treated alumina powder 2 to 2.0 wt. parts and to 3.0 wt. parts.

The image formed on an OHP showed a low transparency and failed to provide clear OHP images. The toner images formed in a normal temperature/normal humidity environment (23° C./65% RH) were rough.

EXAMPLE 2

Negatively chargeable non-magnetic toner particles having a weight-average particle size of ca. 6 μm were prepared in the same manner as in Example 1 except for replacing the phthalocyanine pigment with a magenta pigment of quinacridone-type.

A toner and a two-component type developer were prepared and evaluated in the same manner as in Example 1 except for using 100 wt. parts of the toner particles and 1.5 wt. parts of Treated alumina powder 2. The toner showed an agglomeratability of 16%, indicating a good flowability.

In the low temperature/low humidity environment, images showing a good halftone reproducibility were formed. As a result of long period of continuous image formation, the image density and chargeability were both stable. No problem was encountered also in the high temperature/high humidity environment.

Comparative Example 4

A toner and a two-component type developer were prepared and evaluated in the same manner as in Example 1 except for using Comparative treated alumina powder 3. The toner showed a high agglomeratability of 29%, and the images formed in the low temperature/low humidity environment were generally rough and showed a somewhat low image density of 1.37. This tendency was increasingly noticeable on continuation of the image formation, so that the continuous image formation was interrupted. This was considered attributable to a charge-up phenomenon due to an excessive charge of the toner.

EXAMPLE 3

A toner and a two-component type developer were prepared and evaluated in the same manner as in Example 1 except for using Treated alumina powder 3. Substantially no problem was encountered during continuous image formation in the low temperature/low humidity environment and also in the high temperature/high humidity environment. On continuation of image formation in the low temperature/low humidity environment, the resultant images were accompanied with some roughness at halftone parts, which was however at a practically well acceptable level.

Comparative Example 5

A toner and a two-component type developer were prepared and evaluated in the same manner as in Example 1 except for using Comparative treated titania powder 4. The toner showed a high agglomeratability of 32%, and provided generally rough images even from the initial stage of continuous image formation.

As the amount of Comparative treated titania powder was increased to 2.0 wt. parts and to 2.5 wt. parts, the highlight reproducibility was improved, but noticeable fog and toner scattering occurred in the high temperature/high humidity environment, thus failing to accomplish a satisfactory performance in combination with its performance in the low temperature/low humidity environment.

EXAMPLE 4

Negatively chargeable non-magnetic toner particles having a weight-average particle size of ca. 8.5 μm were prepared in a similar manner as in Example 1. The toner particles in 100 wt. parts and 1.0 wt. part of Treated alumina powder 1 were blended to prepare a cyan toner, from which a two-component type developer was prepared in a similar manner as in Example 1 except that the toner concentration was changed to 8 wt. %.

The developer was evaluated by continuous image formation in the low temperature/low humidity environment, whereby the resultant images showed a stably high image density of 1.63 but a somewhat lower highlight reproducibility than in Example 1, which however was at a practically well acceptable level.

TABLE 1

Properties of Treated Powders

| Treated powder | $S_{BET}$ of base powder ($m^2/g$) | Treating agent *1 | Treating agent *2 | Dav. (nm) | $H_{MeOH}$ (%) | $S_{BET}$ ($m^2/g$) | $I_{a-max}/I_{a-min}$ | $I_{b-max}/I_{b-min}$ |
|---|---|---|---|---|---|---|---|---|
| Alumina 1 | 360 | IBTMOS | 30 | 5 | 63 | 270 | 3.16 | 1.7 |
| Alumina 2 | 250 | NBTMOS | 25 | 5 | 64 | 198 | 4.30 | 1.9 |
| Alumina 3 | 250 | NBTMOS | 40 | 5 | 69 | 125 | 4.30 | 1.9 |
| Alumina 4 | 180 | IBTMOS | 20 | 10 | 62 | 135 | 5.50 | 2.60 |
| Comparative Alumina 1 | 100 | IBTMOS | 30 | 20 | 62 | 86 | 6.12 | 2.5 |
| Comparative Alumina 2 | 20 (α-alumina) | IBTMOS | 10 | 150 | 30 | 20 | 67.20 | 61.0 |
| Comparative Alumina 3 | 146 | IBTMOS | 20 | 10 | 61 | 105 | 6.20 | 3.20 |
| Comparative Alumina 4 | 100 (rutile) | IBTMOS | 15 | 30 | 67 | 82 | — | — |

*1: IBTMOS: isobutyltrimethoxysilane
NBTMOS: n-butyltrimethoxysilane
*2: Treating amount in wt. parts per 100 wt. parts of the base powder.

TABLE 2

Particle size distribution agglomeratability of toners

| | Particle size distribution | | | | | |
|---|---|---|---|---|---|---|
| | $D_4$ (nm) | ≦4 μm (number %) | ≦5.04 μm (number %) | ≧8 μm (vol. %) | ≧10.08 μm (vol. %) | Agglomeratability (%) |
| Ex. 1 | 5.7 | 29.3 | 56.6 | 4.4 | 0 | 12 |
| Comp. Ex. 1 | 5.7 | 29.3 | 56.6 | 4.4 | 0 | 21 |
| Comp. Ex. 2 | 5.7 | 29.3 | 56.6 | 4.4 | 0 | 41 |
| Comp. Ex. 3 | 5.7 | 29.3 | 56.6 | 4.4 | 0 | 56 |
| Ex. 2 | 6.0 | 21.3 | 49.6 | 5.9 | 0.3 | 16 |
| Ex. 3 | 6.0 | 21.3 | 49.6 | 5.9 | 0.3 | 29 |
| Ex. 4 | 6.0 | 21.3 | 49.6 | 5.9 | 0.3 | 24 |
| Comp. Ex. 4 | 5.7 | 29.3 | 56.6 | 4.4 | 0 | 32 |
| Comp. Ex. 5 | 5.7 | 29.3 | 56.6 | 4.4 | 0 | 47 |
| Ex. 4 | 8.5 | 4.0 | 15.2 | 54.6 | 12.9 | 8 |

TABLE 3

| | External additive | | Image-forming performances | | | | | | | | |
|---|---|---|---|---|---|---|---|---|---|---|---|
| | | | 20° C./10% RH | | | 30° C./80% RH | | OHP | | | |
| | Treated powder | Amount (wt. parts) | I.D. | Halftone | Charge-up suppress | I.D. | Halftone | transparency | Fog | Scatter | Continuous |
| Ex. 1 | Alumina 1 | 1.2 | 1.54 | ⊙ | ⊙ | 1.68 | ⊙ | ⊙ | ⊙ | ⊙ | ⊙ |
| Comp. Ex. 1 | Alumina (untreated) | 1.2 | 1.65 | ○ | ○ | 1.92 | x | ○ | x | x | x |
| Comp. Ex. 2 | Comparative alumina 1 | 1.2 | 1.57 | x | x | 1.73 | x | ○ | x | Δ | Δ |
| Comp. Ex. 3 | Comparative Alumina 2 | 3.0 | 1.20 | x | x | 1.28 | x | x | Δ | Δ | x |
| Ex. 2 | Alumina 2 | 1.5 | 1.62 | ⊙ | ⊙ | 1.71 | ⊙ | ⊙ | ⊙ | ⊙ | ⊙ |
| Ex. 3 | Alumina 3 | 1.5 | 1.37 | Δ | ○ | 1.63 | ○ | ⊙ | ○ | ○ | ○ |
| Ex. 4 | Alumina 4 | 1.5 | 1.52 | ○ | ⊙ | 1.63 | ○ | ⊙ | ○ | ⊙ | ○ |
| Comp. Ex. 4 | Comparative alumina 3 | 1.5 | 1.53 | x | x | 1.77 | x | ○ | x | ○ | Δ |
| Comp. Ex. 5 | Comparative titania 4 | 1.5 | 1.43 | x | Δ | 1.65 | x | ○ | x | Δ | Δ |
| Ex. 4 | Alumina 1 | 1.0 | 1.63 | ○ | ⊙ | 1.75 | ○ | ⊙ | ○ | ○ | ⊙ |

The manner and standards of evaluation appear below.

[Notes to Tables 3 and 6]

The manner and standards of evaluation in Table 3 and Table 6 for the respective items are as follows.

Halftone reproducibility

Evaluation at 4 levels was performed with reference to the original image:

⊙: Excellent uniform reproducibility and stability at halftone parts.

○: Excellent reproducibility and stability at halftone parts.

Δ: Slight roughness was observed but at a practically well acceptable level.

x: Much roughness.

Charge-up suppressing performance

The change in toner charge (ΔTC) in a continuous image formation was evaluated at 4 levels according to the following standard.

⊙: ΔTC ≦ 3 mC/kg

○: 3 mC/kg < ΔTC ≦ 5 mC/kg

Δ: 5 mC/kg < ΔTC ≦ 7 mC/kg x: 7 mC/kg < ΔTC

OHP transparency

A toner image formed on an OHP film was projected by an overhead projector onto a screen and the projected image was evaluated with eyes according to the following standard.

⊙: Good transparency and clear hue.

○: Good transparency but slightly lower clarity.

Δ: Slightly inferior transparency but practically of no problem.

x: Poor transparency and inferior color generation.

Fog

A commercially available fog reflection densitometer ("REFLECTOMETER MODEL TC-6DS", available from Tokyo Denshoku K. K.) was used to measure a fog reflection percentage according to the following formula:

Fog reflection percentage (F.R.) (%) = (reflectance from standard paper) - (an average of 5 reflectance values for sample images).

The evaluation was performed at 4 levels according to the following standard.

⊙: F.R. ≦ 0.5%,

○: 0.5% < F.R. ≦ 1.0%,

Δ: 1.0% < F.R. ≦ 1.5%, x: 1.5% < F.R.

Toner scattering

The amount of toner attached around the developing device after 10,000 sheets of continuous image formation was observed with eyes and evaluated according to the following standard.

⊙: No toner attachment at all

○: Substantially no toner attachment

Δ: Slight toner attachment but practically of no problem x: Noticeable toner attachment Continuous image formation performance From the image density change and fog (reflectance) value during 10,000 sheets of continuous image formation, the evaluation of continuous image formation performance was performed at the following 4 levels according to the following standard.

⊙: Image density change before and after the continuous image formation was within ±0.10%, and the worst fog at non-image portion was at most 0.5%.

○: Image density change before and after the continuous image formation was within ±0.15%, and the worst fog at non-image portion was larger than 0.5% and at most 1.0%.

Δ: Image density change before and after the continuous image formation was within ±0.20%, and the worst fog at non-image portion was larger than 1.0% and at most 1.0%.

x: Image density change before and after the continuous image formation exceeded ±0.20%, or the worst fog at non-image portion exceeded 2.0%.

Synthesis Example 5 of organically treated alumina powder

Into 3 liter of 2M-ammonium bicarbonate solution, 2 liter of 0.2M-ammonium alum solution was added dropwise in 1 hour while maintaining the liquid temperature at 35° C. to cause a reaction under vigorous stirring to form fine powder of aluminum ammonium carbonate hydroxide $NH_4AlCO_3(OH)_2$, which was then filtered and dried. The fine powder showed a BET specific surface area ($S_{BET}$) of 560 $m^2/g$. The powder was heat-treated at ca. 850° C. for ca. 2 hours to form hydrophillic alumina powder, which showed $S_{BET}$=250 $m^2/g$ and γ-crystal form as confirmed by X-ray diffraction.

Then, the alumina powder was uniformly dispersed in toluene, and isobutyltrimethoxysilane was added dropwise thereto in a proportion of solid content of 30 wt. parks per 100 wt. parts of the alumina powder so as to cause hydrolysis without causing coalescence of the particles. Then, the product was filtered, dried and baked at 180° C. for 2 hours, followed by sufficient disintegration to form Treated alumina powder 5, which showed a primary particle size (Dav.) of 0.005 μm, $S_{BET}$=190 $m^2/g$ and a methanol hydrophobicity ($H_{MeOH}$) of 66%. The properties are summarized in Table 4 appearing hereinafter.

Synthesis Example 6 of organically treated alumina powder $NH_4AlCO_3(OH)_2$ crystal produced in Synthesis Example 5 was calcined at ca. 550° C. for 2 hours to produce alumina powder.

Then, the alumina powder was uniformly dispersed in toluene, and n-octyltriethoxysilane was added in solid content of 20 wt. parts per 100 wt. parts of the alumina powder, otherwise in a similar manner as in Synthesis Example 5, to form treated alumina powder 6, the properties of which are shown in Table 4.

Comparative Synthesis Example 5 of organically treated alumina powder

A commercially available aluminum oxide fine powder in the form of γ-alumina ("Oxide-C", available from Nippon Aerosil K.K.; $S_{BET}$=100 $m^2/g$) was surface-treated for hydrophobization with 15 wt. parts of isobutyltrimethoxysilane in a similar manner as in Synthesis Example 5 to prepare Comparative treated alumina powder 5.

Comparative Synthesis Example 6 of organically treated alumina powder $NH_4AlCO_3(OH)_2$ crystal produced in Synthesis Example 5 was calcined at ca. 1260° C. for ca. 60 min. to form α-alumina powder, which provided an X-ray diffraction pattern showing sharp peaks and was confirmed to be of the α-form.

The α-alumina powder was surface-treated by hydrophobization with 10 wt. parts of isobutyltrimethoxysilane, otherwise in a similar manner as in Synthesis Example 5 to prepare Comparative treated alumina powder 6.

Comparative Synthesis Example 7 of treated powder

Commercially available hydrophobic silica fine powder ("AEROSIL R-200", available from Nippon Aerosil K.K.; $S_{BET}$=200 $m^2/g$) was hydrophobized similarly as in Synthesis Example 5 to prepare Comparative treated silica powder 7.

Comparative Synthesis Example 8 of treated powder

Amorphous titanium oxide powder ($S_{BET}$=135 $m^2/g$) formed by oxidation of titanium alkoxide was hydrophobized with 20 wt. parts of isobutyltrimethoxysilane otherwise in a similar manner as in Synthesis Example to obtain Comparative treated titania powder 8.

The properties of the above-prepared powders are summarized in Table 4.

TABLE 4

Physical properties of treated powders

| Treated powder | $S_{BET}$ of base powder ($m^2/g$) | Treating agent *1 | Treating amount *2 (wt. parts) | Dav. (nm) | $H_{MeOH}$ (%) | $S_{BET}$ ($m^2/g$) | $I_{a-max}/I_{a-min}$ | $I_{b-max}/I_{b-min}$ |
|---|---|---|---|---|---|---|---|---|
| Alumina 5 | 250 | IBTMOS | 30 | 5 | 66 | 190 | 4.78 | 1.92 |
| Alumina 6 | 380 | NOTMOS | 20 | 5 | 64 | 282 | 3.28 | 1.68 |
| Comparative alumina 5 | 100 | IBTMOS | 15 | 20 | 62 | 86 | 6.20 | 2.68 |
| Comparative alumina 6 | 10 | IBTMOS | 10 | 180 | 30 | 20 | 71.30 | 64.2 |
| Comparative silica 7 | 200 | IBTMOS | 30 | 5 | 32 | 185 | — | — |
| Comparative titania 8 | 135 | IBTMOS | 30 | 17 | 62 | 82 | — | — |

*1: IBTMOS: isobutyltrimethoxysilane
NOTMOS: n-octyltrimethoxysilane
*2: Treating amount in wt. parts per 100 wt. parts of the base power.

EXAMPLE 5

Negatively chargeable non-magnetic cyan toner particles having a weight-average particle size of 5.8 μm were prepared in the same manner as in Example 1, and 100 wt. parts of the toner particles were blended with 1.5 wt. part of Treated alumina powder 5 of Synthesis Example 5 as an external additive to prepare a cyan toner, which was evaluated in the same as in Example 1. The properties of the toner are shown in Table 5 appearing hereinafter.

The resultant toner images showed a high image density of 1.62 and were found to be clear and free from fog. The copying was further continued on 10,000 sheets and, during that time, the resultant images were accompanied with only a small density fluctuation of 0.08 and were clear and fog-free similarly as in the initial stage. Image formation was also performed in a low temperature/low humidity environment of 20° C./10% RH at a similarly set developing contrast of 300 volts, whereby the resultant images showed a high image density of 1.54, indicating a good chargeability control in a low humidity environment.

A cyan toner image transferred onto an OHP film and fixed thereon was subjected to overhead projection, thereby providing a clear cyan projected image on a screen.

Image formation was also performed in a high temperature/high humidity environment of 30° C./80% RH at a set developing contrast of 300 volts, whereby good images showing a very stable image density of 1.68 were formed.

Further, when the developer was subjected to standing for one month in environments of 23° C./60% RH, 20° C./10% RH and 30° C./80% RH, the developer after the standing in each environment showed no abnormality.

The results are summarized in Table 6.

EXAMPLE 6

Negatively chargeable non-magnetic toner particles having a weight-average particle size of ca. 6 μm were prepared in the same manner as in Example 5 except for replacing the phthalocyanine pigment with a magenta pigment of quinacridone-type.

A toner and a two-component type developer were prepared and evaluated in the same manner as in Example 5 except for using 100 wt. parts of the toner particles and 1.2 wt. parts of Treated alumina powder 6. The toner showed an agglomeratability of 16%, indicating a good flowability.

In the low temperature/low humidity environment, images showing a good half-tone reproducibility were formed. As a result of long period of continuous image formation, the image density and chargeability were both stable. No problem was encountered also in a high temperature/high humidity environment.

Comparative Example 6

A toner and a two-component type developer were prepared in the same manner as in Example 5 and evaluated in the same manner as in Example 1 except for using Comparative treated alumina powder 5.

As a result of continuous image formation in the high temperature/high humidity environment, the toner showed a stable chargeability in the initial stage but, on continuation of the image formation, the chargeability was lowered to result in severe toner scattering in the apparatus, so that the image formation was interrupted.

Comparative Example 7

A toner and a two-component type developer were prepared in the same manner as in Example 5 and evaluated in the same manner as in Example 1 except for using Comparative treated alumina powder 6. The toner showed a high agglomeratability of 56%, and the agglomeratability was not substantially improved even when the external addition amount of Comparative treated alumina powder 6 to 2.0 wt. parts and to 3.0 wt. parts.

The image formed on an OHP showed a low transparency and failed to provide clear OHP images. The toner images formed in an environment of 23° C./65% RH were rough from the initial stages.

Comparative Example 8

A toner was prepared in the same manner as in Example 5 except for using Comparative treated silica powder 7 and evaluated in the same manner as in Example 1.

In the low temperature/low humidity environment, the resultant images were accompanied with noticeable ununiformity at a solid image part which was presumably caused by transfer failure and showed a roughness at a halftone part. In the high temperature/high humidity environment, fairly good images were obtained but, on continuation of image formation, the chargeability was lowered to initiate toner scattering.

A density difference of 0.52 was observed between the low temperature/low humidity environment and the high temperature/high humidity environment.

Comparative Example 9

A toner was prepared in the same manner as in Example 5 except for using Comparative treated titania powder 8 and evaluated in the same manner as in Example 1.

In the high temperature/high humidity environment, good images were formed at the initial stage but, on continuation of the image formation, the chargeability was liable to be lowered to result in slight noticeable roughening of images.

As a result of observation of toner particles through an SEM, it was confirmed that some agglomerate particles of titania powder were attached to the toner particle surfaces, so that the proportion of particles attached in the form of primary particle was less than that in Example 5.

The roughening of the image was not removed even when the external addition amount of the titania powder was increased to 2 wt. parts.

EXAMPLE 7

Negatively chargeable non-magnetic toner particles having a weight-average particle size of ca. 8.5 μm were prepared in a similar manner as in Example 1. The toner particles in 100 wt. parts and 1.0 wt. part of Treated alumina powder 5 were blended to prepare a cyan toner, from which a two-component type developer was prepared in a similar manner as in Example 1 except that the toner concentration was changed to 6.5 wt. %.

The developer was evaluated by continuous image formation in the low temperature/low humidity environment, whereby the resultant images showed a stably high image density of 1.63 but a somewhat lower highlight reproducibility than in Example 1.

EXAMPLE 8

A cyan toner prepared in the same manner as in Example 5 was charged in a developing apparatus having a structure shown in FIG. 1 and subjected to an image formation test, whereby good cyan toner images were obtained.

TABLE 5

| | Particle size distribution agglomeratability of toners | | | | | |
|---|---|---|---|---|---|---|
| | | Particle size distribution | | | | |
| | $D_4$ (nm) | ≦4 μm (number %) | ≦5.04 μm (number %) | ≧8 μm (vol. %) | ≧10.08 μm (vol. %) | Agglomeratability (%) |
| Ex. 5 | 5.8 | 28.3 | 55.6 | 4.5 | 0 | 15 |
| Ex. 6 | 6.0 | 21.4 | 48.5 | 6.2 | 0.6 | 16 |
| Comp. Ex. 6 | 5.8 | 28.3 | 55.6 | 4.5 | 0 | 42 |
| Comp. Ex. 7 | 5.8 | 28.3 | 55.6 | 4.5 | 0 | 56 |
| Comp. Ex. 8 | 5.8 | 28.3 | 55.6 | 4.5 | 0 | 31 |
| Comp. Ex. 9 | 5.8 | 28.3 | 55.6 | 4.5 | 0 | 35 |
| Ex. 7 | 8.5 | 4.0 | 14.5 | 52.2 | 12.3 | 19 |

TABLE 6

| | External additive | | Image-forming performance | | | | | | | |
|---|---|---|---|---|---|---|---|---|---|---|
| | | | 20° C./10% RH | | 30° C./80% RH | | | | | |
| | Treated powder | Amount *1 (wt. parts) | I.D. | Halftone | I.D. | Halftone | OHP transparency | Fog | Scatter | Remarks *2 |
| Ex. 5 | Alumina 5 | 1.5 | 1.54 | ⊙ | 1.68 | ⊙ | ⊙ | ⊙ | ⊙ | AAA |
| Ex. 6 | Alumina 6 | 1.2 | 1.60 | ⊙ | 1.83 | ⊙ | ○ | ○ | ○ | — |
| Comp. Ex. 6 | Comparative alumina 5 | 2.0 | 1.57 | Δ | 1.73 | Δ | Δ | x | x | BBB |
| Comp. Ex. 7 | Comparative alumina 6 | 3.0 | — | x | — | x | x | Δ | Δ | CCC |
| Comp. Ex. 8 | Comparative silica 7 | 1.2 | 1.25 | x | 1.77 | Δ | ○ | Δ | Δ | DDD |
| Comp. Ex. 9 | Comparative titania 8 | 1.5 | 1.59 | Δ | 1.70 | x | ○ | ○ | ○ | — |
| Ex. 7 | Alumina 5 | 1.0 | 1.63 | ○ | 1.74 | ○ | ⊙ | ⊙ | ⊙ | — |

*1, *2: The notes to this table appear below.

[Notes to TABLE 6]

The manner and standard of evaluation are generally the same as in TABLE 3.

*1: Amount of the treated powder in wt. parts per 100 wt. parts of the toner particles.

*2: In the remarks, the symbols have the following meaning.

AAA: The continuous image forming performances were also good.

BBB: Vigorous toner scattering, and a generally lower chargeability.

CCC: Poor OHP transparency.

DDD: Poor transferability in the low temperature/low humidity environment.

What is claimed is:

1. A toner for developing electrostatic images, comprising: toner particles and organically treated alumina powder;

wherein the organically treated alumina powder has an X-ray diffraction characteristic showing a maximum X-ray intensity level $I_{a\text{-}max}$ and a minimum X-ray intensity level $I_{a\text{-}min}$ in a 2θ range of 2θ to 70 degrees providing a ratio $I_{a\text{-}max}/I_{a\text{-}min}$ of below 6.

2. The toner according to claim 1, wherein the organically treated alumina powder has a primary particle size of 0.002–0.1 μm.

3. The toner according to claim 1 or 2, wherein the organically treated alumina powder has a BET specific surface area by nitrogen adsorption of at least 130 $m^2/g$ and a methanol hydrophobicity of 30–90%.

4. The toner according to claim 1, wherein the organically treated alumina powder has been treated for hydrophobization in a liquid medium.

5. The toner according to claim 1 or 4, wherein the organically treated alumina powder has been treated by a silane organic compound.

6. The toner according to claim 5, wherein the silane organic compound is a silane coupling agent.

7. The toner according to claim 1, wherein the organically treated alumina powder has a BET specific surface area of at least 150 $m^2/g$.

8. The toner according to claim 1, wherein the toner has a weight-average particle size of 3–7 μm.

9. The toner according to claim 1, wherein the organically treated alumina powder is contained in 0.5–5 wt. parts per 100 wt. parts of the toner particles.

10. The toner according to claim 1, wherein the X-ray diffraction characteristic of the organically treated alumina powder includes a maximum X-ray intensity level $I_{b\text{-}max}$ and a minimum X-ray intensity level $I_{b\text{-}min}$ in a 2θ range of 30 to 40 degrees providing a ratio $I_{b\text{-}max}/I_{b\text{-}min}$ of below 2.

11. The toner according to claim 10, wherein the organically treated alumina powder has a primary particle size of 0.002–0.1 μm, a BET specific surface area by nitrogen adsorption of at least 130 $m^2/g$ and a methanol hydrophobicity of 30–90%.

12. The toner according to claim 11, wherein the organically treated alumina powder has a BET specific surface area of at least 150 $m^2/g$.

13. The toner according to claim 10, wherein the organically treated alumina powder is contained in 0.5–5 wt. parts per 100 wt. parts of the toner particles.

14. The toner according to claim 11, wherein the organically treated alumina powder has been treated for hydrophobization in a liquid medium.

15. The toner according to claim 14, wherein the organically treated alumina powder has been treated by a silane organic compound.

16. The toner according to claim 15, wherein the silane organic compound is a silane coupling agent.

17. The toner according to claim 10, wherein the toner has a weight-average particle size of 3–7 μm.

18. The toner according to claim 1, wherein the toner particles are non-magnetic.

19. The toner according to claim 18, wherein the toner particles are negatively chargeable and non-magnetic.

20. The toner according to claim 1, wherein the organically treated alumina powder has been formed by organically treating alumina powder which in turn has been obtained by pyrolysis of aluminum ammonium carbonate hydroxide powder having a BET specific surface area of at least 130 $m^2/g$.

21. The toner according to claim 20, wherein the aluminum ammonium carbonate hydroxide is represented by the following formula (1) or (2):

$$NH_4Al(O)(OH)HCO_3 \quad (1),$$

or $$NH_4AlCO_3(OH)_2 \quad (2).$$

22. The toner according to claim 20 or 21, wherein the aluminum ammonium carbonate hydroxide powder is pyrolized at 300°–1200° C.

23. The toner according to claim 20, wherein the organically treated alumina powder has been treated by a hydrophobizing agent.

24. The toner according to claim 23, wherein the organically treated alumina powder has a methanol hydrophobicity of 30–90%.

25. The toner according to claim 24, wherein the organically treated alumina powder has been prepared by treating alumina powder with a silane organic compound.

26. The toner according to claim 25, wherein the silane organic compound is a silane coupling agent.

27. The toner according to claim 1, wherein the toner particles comprise a polyester resin.

28. The toner according to claim 8, wherein the toner contains 10–70% by number of toner particles having a particle size of at most 4 μm.

29. The toner according to claim 28, wherein the toner contains 15–60% by number of toner particles having a particle size of at most 4 μm.

30. The toner according to claim 8, wherein the toner contains 2–20% by volume of toner particles having a particle size of at least 8 μm.

31. The toner according to claim 30, wherein the toner contains 3–18.0% by number of toner particles having a particle size of at least 8 μm.

32. The toner according to claim 8, wherein the toner contains 40–90% by number of toner particles having a particle size of at most 5.04 μm, and at most 6% by volume of toner particles having a particle size of at least 10.8 μm.

33. The toner according to claim 32, wherein the toner contains 40–80% by number of toner particles having a particle size of at most 5.04 μm, and at most 4% by volume of toner particles having a particle size of at least 10.8 μm.

34. The toner according to claim 1, wherein the toner shows an agglomeratability of 2–25%.

35. The toner according to claim 34, wherein the toner shows an agglomeratability of 2–20%.

36. The toner according to claim 35, wherein the toner shows an agglomeratability of 2–15%.

* * * * *

UNITED STATES PATENT AND TRADEMARK OFFICE

CERTIFICATE OF CORRECTION

PATENT NO. : 5,607,806

DATED : March 4, 1997

INVENTOR(S) : MAKOTO KANBAYASHI ET AL.

It is certified that error appears in the above-identified patent and that said Letters Patent is hereby corrected as shown below:

AT [57] ABSTRACT

Line 11, "contained" should be deleted.

COLUMN 2

Line 37, "comprise" should read --comprises--.

COLUMN 3

Line 26, "silicone" should read --silicon--.

COLUMN 4

Line 3, "environment" should read --environments--.

COLUMN 5

Line 47, "show" should read --shows--.
Line 56, "contain" should read --contains--.

COLUMN 6

Line 14, "Imax/Imin>6" should read --Imax/Imin<6--.

COLUMN 9

Line 30, "allows" should read --allow--.

UNITED STATES PATENT AND TRADEMARK OFFICE

CERTIFICATE OF CORRECTION

PATENT NO. : 5,607,806

DATED : March 4, 1997

INVENTOR(S) : MAKOTO KANBAYASHI ET AL.

It is certified that error appears in the above-identified patent and that said Letters Patent is hereby corrected as shown below:

COLUMN 11

Line 9, "polyeter" should read --polyester--.

COLUMN 13

Line 45, "developer carrying" should read --developer-carrying--.

COLUMN 14

Line 15, "alone" should read --along--.

COLUMN 16

Line 18, "Sample" should read --sample--.
Line 57, "by" should read --when--.
Line 58, "hydrophpbicity" should read --hydrophobicity--.

COLUMN 17

Line 50, "hydrophillic" should read --hydrophilic--.
Line 52, "hydrophillic" should read --hydrophilic--.

COLUMN 18

Line 39, "($S_{BET}$146$m^2$/g)" should read --($S_{BET}$=146$m^2$/g)--.

COLUMN 19

Line 11, "al most" should be deleted.

UNITED STATES PATENT AND TRADEMARK OFFICE

CERTIFICATE OF CORRECTION

PATENT NO. : 5,607,806

DATED : March 4, 1997

INVENTOR(S) : MAKOTO KANBAYASHI ET AL. Page 3 of 4

It is certified that error appears in the above-identified patent and that said Letters Patent is hereby corrected as shown below:

COLUMN 23

Table 3, "transparency OHP Fog Scatter" should read --transparency Fog Scatter--.

COLUMN 25

Line 11, "hydrophillic" should read --hydrophilic--.
Line 16, "parks" should read --parts--.

COLUMN 26

Line 27, "Example" should read --Example 5--.
Table 4, "power." should read --powder.--.
Line 59, "same" should read --same manner--.

COLUMN 27

Line 32, "half-tone" should read --halftone--.
Line 58, "powder" should read --powder was changed to--.

UNITED STATES PATENT AND TRADEMARK OFFICE

CERTIFICATE OF CORRECTION

PATENT NO. : 5,607,806

DATED : March 4, 1997

INVENTOR(S) : MAKOTO KANBAYASHI ET AL. Page 4 of 4

It is certified that error appears in the above-identified patent and that said Letters Patent is hereby corrected as shown below:

COLUMN 29

Line 51, "20 range" should read --2θ range-- and "2θ" should read --20--.

Signed and Sealed this

Sixteenth Day of September, 1997

Attest:

Bruce Lehman

BRUCE LEHMAN

Attesting Officer

Commissioner of Patents and Trademarks